US006860326B2

(12) United States Patent
Kilgore et al.

(10) Patent No.: US 6,860,326 B2
(45) Date of Patent: Mar. 1, 2005

(54) PACKER RELEASING METHODS

(75) Inventors: Marion D. Kilgore, Dallas, TX (US); Daniel L. Patterson, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/224,988

(22) Filed: Aug. 21, 2002

(65) Prior Publication Data

US 2004/0035589 A1 Feb. 26, 2004

(51) Int. Cl.[7] ..... E21B 33/00
(52) U.S. Cl. ..... 166/120; 166/138
(58) Field of Search ..... 166/120, 217, 166/123, 125, 138, 179, 126, 129, 131, 133

(56) References Cited

U.S. PATENT DOCUMENTS 4,271,903 A * 6/1981 Slagle et al. ..... 166/129
4,467,867 A * 8/1984 Baker ..... 166/188
4,505,332 A * 3/1985 Mills et al. ..... 166/120
4,754,812 A * 7/1988 Gentry ..... 166/313
4,930,573 A * 6/1990 Lane et al. ..... 166/120
6,609,567 B2 * 8/2003 Ingram et al. ..... 166/126

OTHER PUBLICATIONS

Halliburton, "PES PR3 Tubing Punch Release Tool", dated Jan. 15,2002.

Halliburton, "PES HP1 Retrievable Packer", dated Oct., 2001.

* cited by examiner

*Primary Examiner*—Frank Tsay
(74) *Attorney, Agent, or Firm*—Konneker & Smith, P.C.

(57) ABSTRACT

Methods of releasing a well tool set in a wellbore are provided. In various embodiments, a well tool, such as a packer, is released from sealing and gripping engagement within a wellbore using alternate methods. A dual-string packer is described in which the packer may be released by severing a mandrel of the packer, displacing a piston of the packer, or by displacing a retaining device in a flow passage of the packer.

33 Claims, 23 Drawing Sheets

PACKER RELEASING METHODS

BACKGROUND

The present invention relates generally to equipment utilized and operations performed in conjunction with subterranean wells and, in embodiments described herein, more particularly provides packer releasing methods.

In general, packers which are releasable by severing a mandrel of the packer using a chemical cutter have no other practical method of releasing the packer. In some cases, such a packer may be releasable by straight shear, that is, by applying an overload to a tubing string attached to the packer. However, this is not practical in many situations, such as that of high performance packers which must withstand extreme tubing loads. Thus, the only practical method of releasing a packer may be chemically cutting through the mandrel.

It would be advantageous to provide other methods of releasing packers which may be used in place of, or in addition to, chemical cutting. Chemical cutting requires specialized crews and equipment, potentially hazardous materials are used (which must be inventoried, stored, handled, transported, disposed of, etc.), and the method is relatively unpredictable in its success. By providing other alternate methods of releasing packers, these alternate methods could be used instead of chemical cutting, or these alternate methods could be used as a backup to the chemical cutting method, or the chemical cutting method could be used as a backup to one or more of the alternate methods.

SUMMARY

In carrying out the principles of the present invention, in accordance with embodiments thereof, methods of releasing well tools are provided. In the described embodiments, the well tool is a packer set in a wellbore. The packer includes features which enable it to be released using multiple methods, in addition to being releasable by chemically cutting through a mandrel thereof.

In one aspect of the invention, a method of releasing a well tool set in a wellbore is provided. The well tool is releasable by severing an internal mandrel of the well tool. The well tool is set in the wellbore and is released by displacing a retaining device positioned at least partially in a flow passage extending through the well tool. The retaining device may be displaced by any of multiple methods. In one described embodiment, the retaining device is positioned in a secondary bore of a dual packer.

In another aspect of the invention, a well tool which is releasable by severing an internal mandrel of the well tool is set in a wellbore. The well tool is released by applying a pressure differential to a piston of the well tool. The pressure differential may be applied by a variety of means.

In yet another aspect of the invention, a method of releasing a well tool set in a wellbore is provided which includes the steps of providing multiple flow passages extending longitudinally through the well tool and through multiple tubular strings connected to the respective flow passages; displacing a retaining device positioned at least partially in one of the flow passages; and releasing the tool in response to the retaining device displacing step.

In a further aspect of the invention, a method of releasing a well tool set in a wellbore is provided which includes the steps of providing the well tool having a control line in fluid communication with a piston of the tool; altering pressure in the control line; displacing the piston in response to the pressure altering step; and releasing the tool in response to the piston displacing step.

In yet another aspect of the invention, a method of releasing a well tool set in a wellbore is provided which includes the steps of installing a perforating device in a flow passage formed longitudinally through the well tool; perforating a barrier preventing fluid communication between the flow passage and a piston of the tool; altering pressure in the flow passage; displacing a piston of the tool in response to the pressure altering step; and releasing the tool in response to the piston displacing step.

In a still further aspect of the invention, a method of releasing a well tool set in a wellbore is provided which includes the steps of: installing a pressure chamber in a flow passage formed longitudinally through the well tool; providing fluid communication between the chamber and one side of a piston of the tool; displacing a piston of the tool in response to the fluid communication providing step; and releasing the tool in response to the piston displacing step.

In another aspect of the invention, a method of releasing a well tool set in a wellbore is provided which includes the steps of installing a plug in a flow passage formed longitudinally through the well tool; altering pressure in the flow passage; displacing a piston of the tool in response to the pressure altering step; and releasing the tool in response to the piston displacing step.

A well tool, such as a packer, may be constructed in which any combination of the above methods may be used to release the packer.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
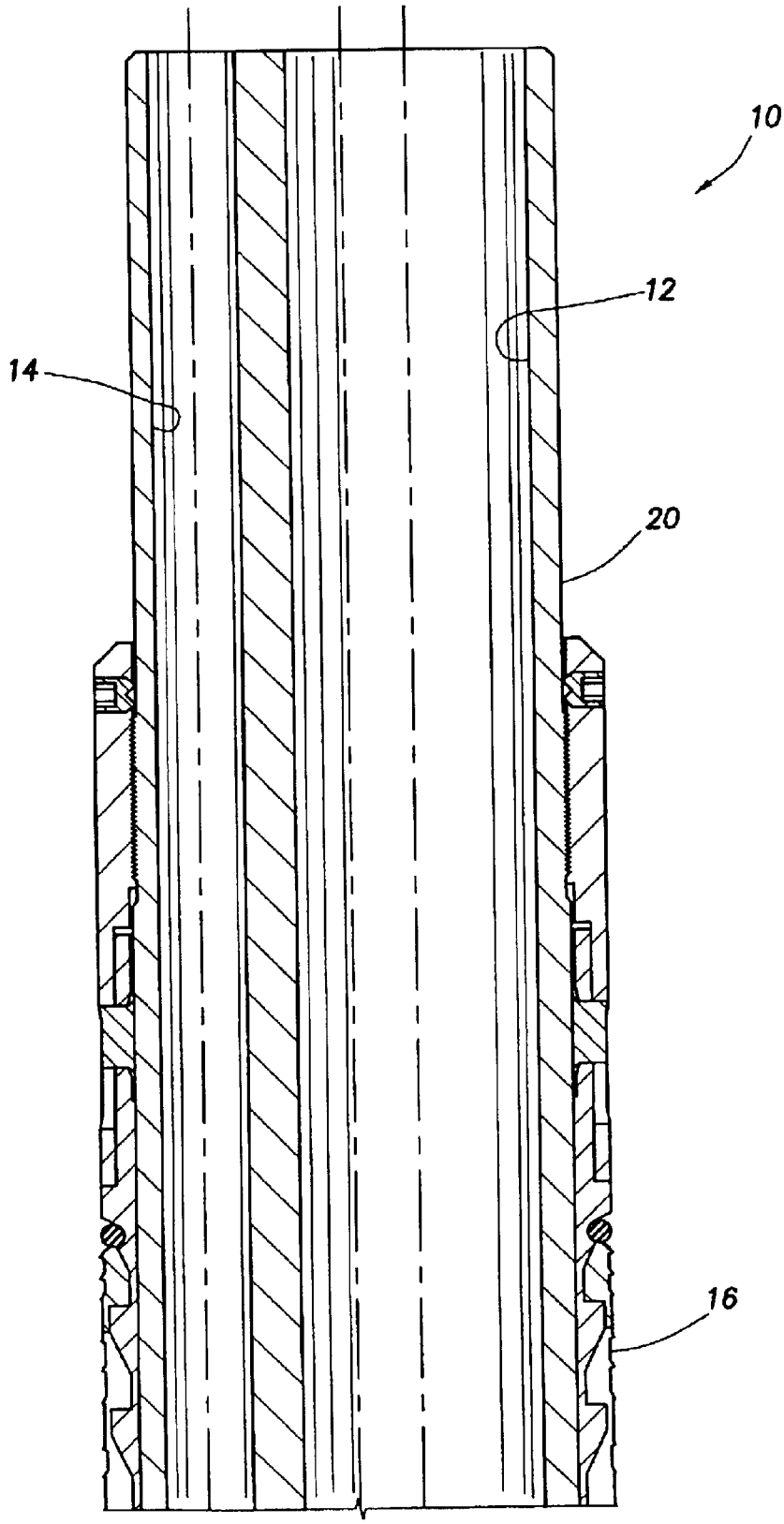
FIGS. 1A–F are successive axial portions of a cross-sectional view of a packer and a first method of releasing same embodying principles of the present invention.
Figure 1B:
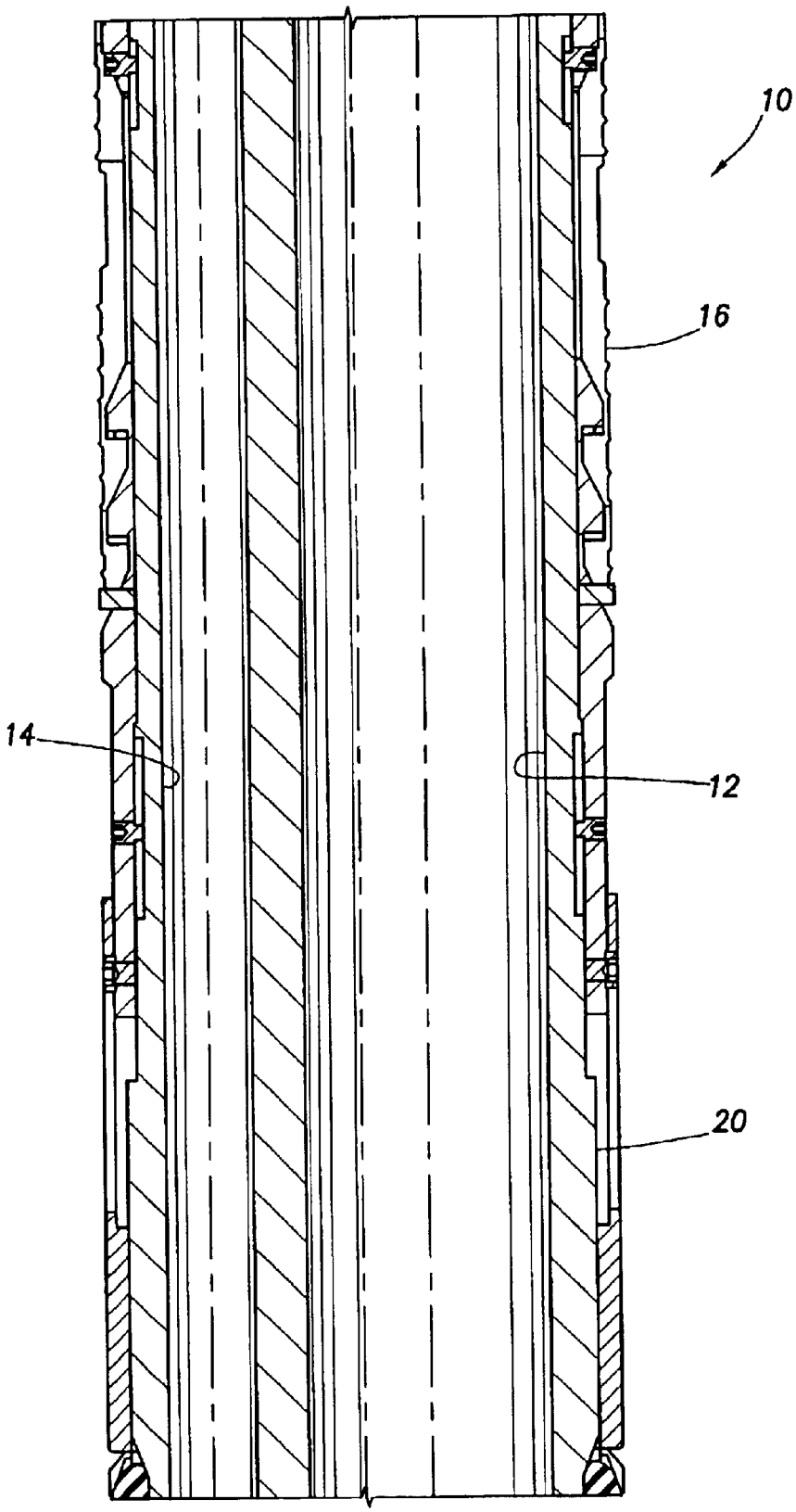

Representatively illustrated in FIG. 1 is a packer 10 which embodies principles of the present invention. In the following description of the packer 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The packer 10 is described herein as an example of a well tool which may be released in a wellbore using the principles of the invention. The packer 10 is a well tool of the type which grips and seals against a wellbore in which it is set. After being set in the wellbore, the packer 10 is released, or "unset", thereby relieving its gripping and sealing engagement with the wellbore. As used herein, the term "set" is used to refer to an operation producing a gripping and/or sealing engagement between a well tool and a wellbore, and the term "release" is used to refer to an operation which relieves the gripping and/or sealing engagement between the well tool and the wellbore.

The packer 10 is similar in many respects to a Model DHC dual string packer marketed by Halliburton Energy Services, Inc. and well known to those skilled in the art. For example, the packer 10 includes primary and secondary flow passages 12, 14 extending therethrough, slips 16 which extend outwardly to grippingly engage a wellbore, and seal elements 18 which extend outwardly to sealingly engage the wellbore. The primary flow passage 12 may, for example, be used for producing well fluids to the surface, and the secondary flow passage 14 may be used for gas injection.

Note that it is not necessary in keeping with the principles of the invention for the well tool to be a packer, for the packer to be a dual string packer, or for the well tool to both grippingly and sealingly engage the wellbore. Other well tools which may incorporate principles of the invention may not be packers, may not be dual string packers, and may only grippingly engage or sealingly engage a wellbore. For example, a non-sealing hanger may be released using the methods described below.

Figure 3:
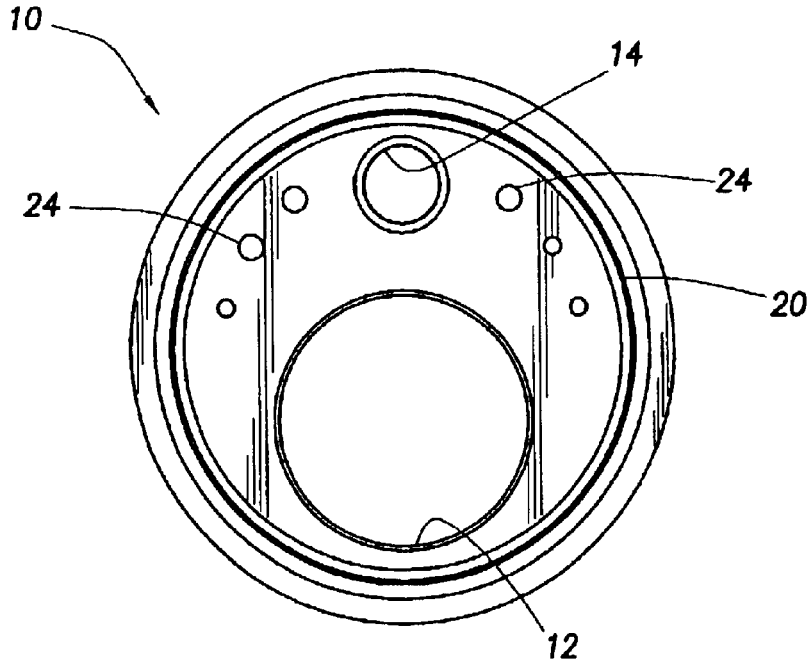
FIG. 3 is a top view of the packer.

In the packer 10, the flow passages 12, 14 are integrally formed in a single mandrel 20. In the top view of the packer 10 illustrated in FIG. 3, the manner in which the two flow passages 12, 14 are formed in the mandrel 20 may be seen. Additional openings 24 may be formed through the mandrel 20 for control lines, other hydraulic or fluid lines, electrical lines, fiber optic lines, etc.

Figure 1C:
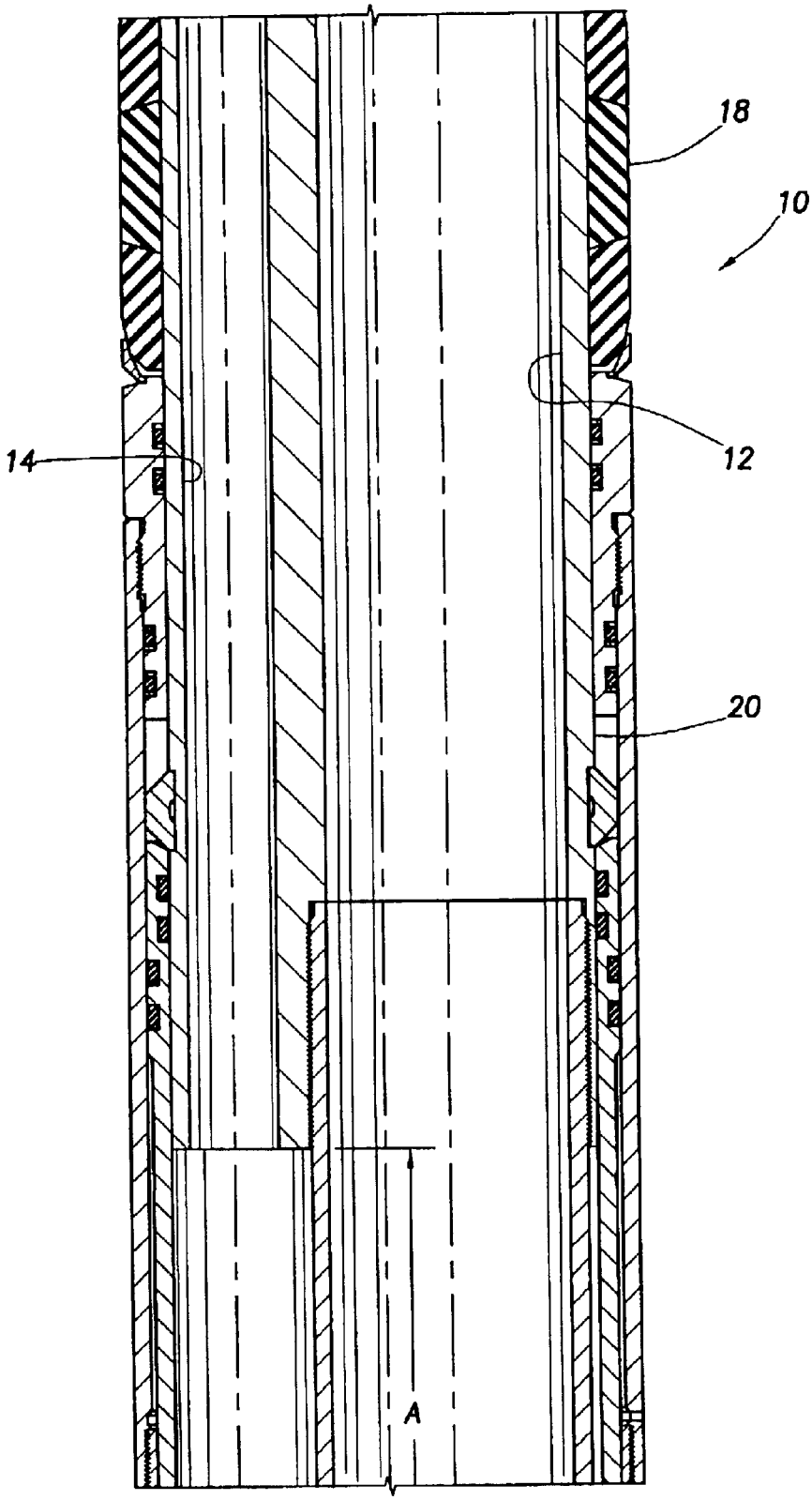
Figure 1D:
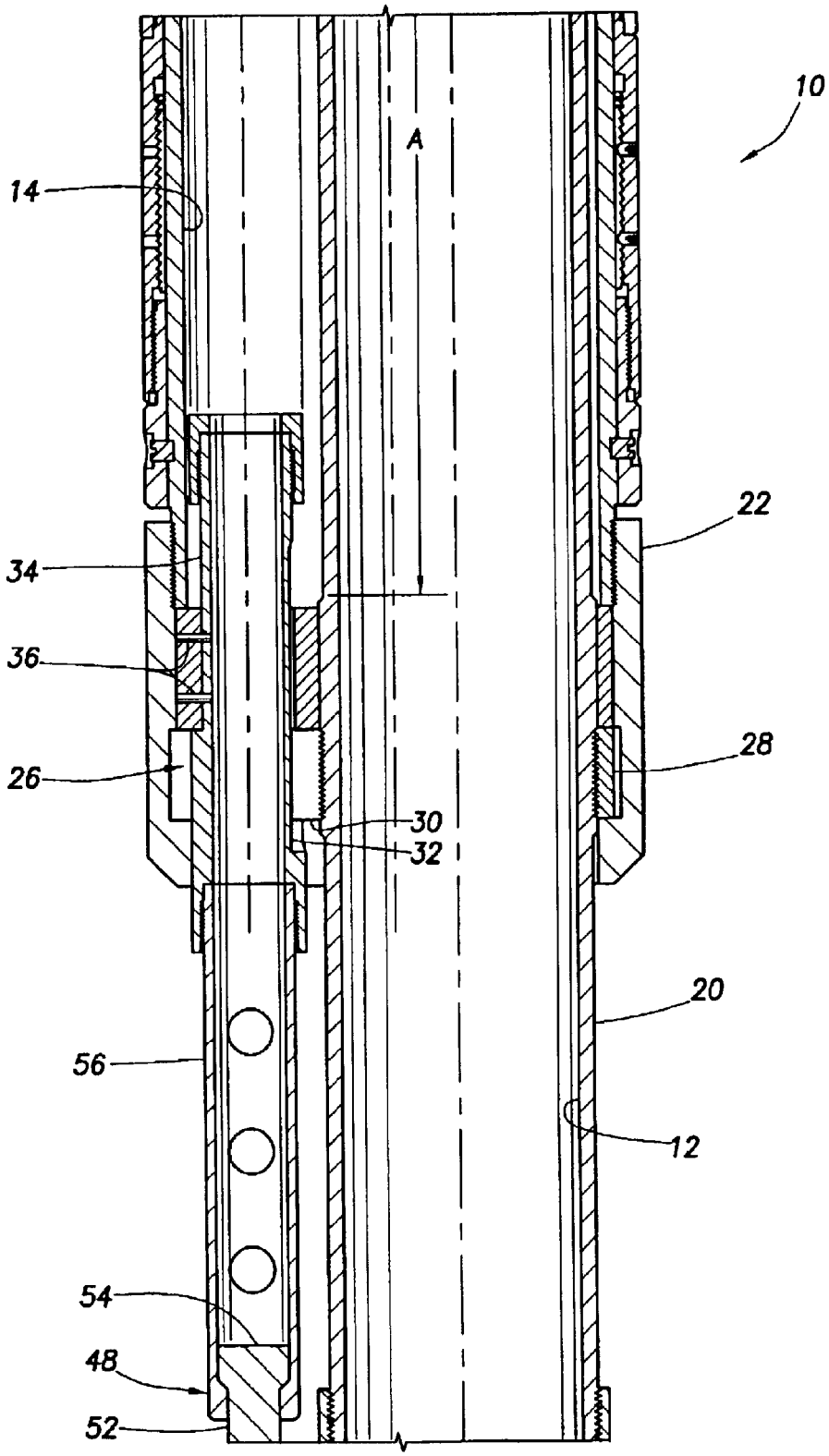

By severing the mandrel 20 in the area indicated by the letter "A" in FIGS. 1C&D, the packer 10 may be released after it is set in a wellbore. For example, the mandrel 20 may be chemically cut in the area "A" to release the packer 10. When the mandrel 20 is cut through, an outer assembly 22 is permitted to displace downwardly relative to the mandrel 20 above the area "A", thereby permitting the slips 16 and seal elements 18 to retract inwardly, and releasing the packer 10.

As an alternate means of releasing the packer 10, the outer assembly 22 is releasably retained against displacement relative to the mandrel 20 by a release mechanism 26. The release mechanism 26 includes a retaining ring 28 exteriorly threadedly engaged with the mandrel 20. The retaining ring 28 is generally C-shaped and has outwardly extending "ears" 30 which are received within a slot 32 formed on a generally tubular retaining device 34.

Although the retaining ring 28 is described herein as being a means by which the outer assembly 22 is releasably retained against displacement relative to the mandrel 20, other retaining means may be used, if desired. For example, a supported collet, supported lugs or dogs, supported snap ring, etc.

The retaining device 34 is releasably secured against sliding displacement in the secondary flow passage 14 by shear pins 36. When the shear pins 36 are sheared and the retaining device 34 is displaced downwardly, the ears 30 will no longer be retained in the slot 32, and the retaining ring 28 will be permitted to expand outwardly, thereby permitting the outer assembly 22 to displace downwardly relative to the mandrel 20, and thereby releasing the packer 10.

Figure 4:
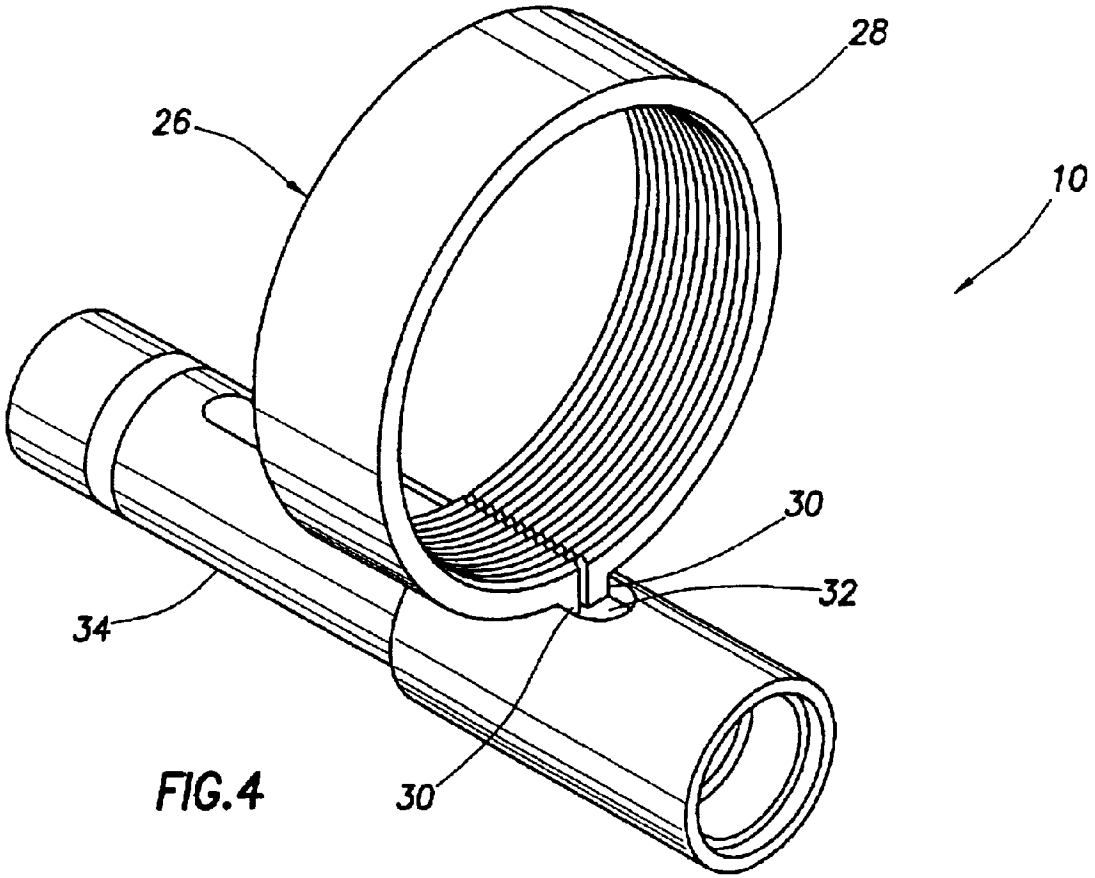
FIG. 4 is an isometric view of a release mechanism of the packer.

In FIG. 4 the release mechanism 26 is illustrated apart from the remainder of the packer 10, so that it may be fully appreciated how the retaining device 34 initially retains the ears 30 in the slot 32. It may also be clearly seen in FIG. 5 that when the retaining device 34 is displaced downwardly the ears 30 are no longer retained in the slot 32 and the C-shaped retaining ring 28 is permitted to expand radially outward out of threaded engagement with the mandrel 20.

Note that the release mechanism 26 is accessible via the secondary flow passage 14. This permits the packer 10 to be released by performing operations in the secondary flow passage 14, without entering the primary flow passage 12, which may be advantageous in some situations. A further advantage of the packer 10 is that the release mechanism 26 may also be actuated by operations performed in the primary flow passage 12, which may be advantageous in other situations.

An annular piston 38 is sealingly and reciprocably disposed about the primary flow passage 12. An upper piston area or side 40 of the piston 38 is in fluid communication with the flow passage 12 via a port 42. A lower piston area or side 44 of the piston 38 is in fluid communication with the flow passage 12 via a port 46. When a pressure differential is created across the piston 38 from the upper side 40 to the lower side 44, the piston will be biased to displace downwardly.

Although the piston 38 is described herein as being annular-shaped, it will be readily appreciated that other types of pistons could be used, such as a rod piston, etc.

The piston 38 is connected to the release mechanism 26 by a coupling 48. The coupling 48 includes a yoke 50, a rod 52 having an enlarged end 54, and a tube 56. The rod 52 is telescopingly received in one end of the tube 56, and the other end of the tube 56 is attached to the retaining device 34.

Figure 2:
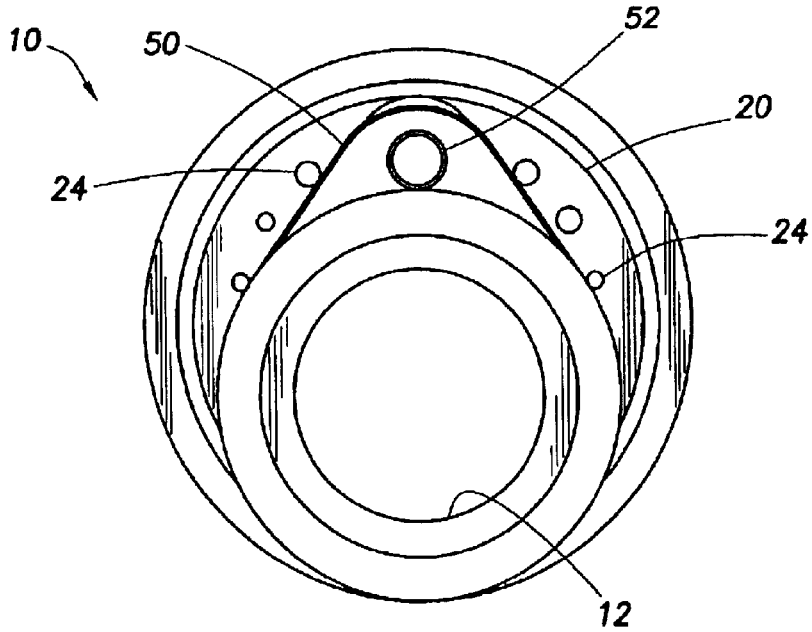
FIG. 2 is a bottom view of the packer.

The yoke 50 is rigidly secured to the piston 38 and to the rod 52. Thus, the piston 38, yoke 50 and rod 52 displace, or remain stationary, as an assembly. In the bottom view of the packer 10 representatively illustrated in FIG. 2, it may be more clearly seen how the yoke 50 is configured relative to the piston 38 and the rod 52.

The coupling 48 is of the type known as a slip or one-way coupling, in that the tube 56 (and the attached retaining device 34) may displace downwardly relative to the rod 52/yoke 50/piston 38 assembly, but when the rod 52/yoke 50/piston 38 assembly displaces downwardly, the tube 56/retaining device 34 assembly also displaces downwardly due to engagement of the enlarged rod end 54 with the lower end of the tube 56. This permits the retaining device 34 to be displaced downwardly, thereby releasing the packer 10, without displacing the piston 38 downwardly. Thus, it is not necessary to displace the piston 38 downwardly to release the packer 10, but the piston 38 may be displaced downwardly, if desired, to cause the retaining device 34 to displace downwardly and release the packer.

As mentioned above, the upper and lower sides 40, 44 of the piston 38 are in fluid communication with the flow passage 12. In this embodiment of the invention, a pressure differential may be created in the flow passage 12, which pressure differential is communicated via the ports 42, 46 to the respective sides 40, 44 of the piston 38, to thereby bias the piston downward. When this downwardly biasing force is sufficiently great, shear screws 58 releasably securing the piston 38 shear, and the downwardly biasing force is transmitted via the coupling 48 to the retaining device 34. When the downwardly biasing force transmitted to the retaining device 34 is sufficiently great, the shear pins 36 shear and the retaining device displaces downward, along with the coupling 48 and piston 38, thereby releasing the packer 10.

Referring additionally now to FIGS. 5A–D, a first method 60 of releasing the packer 10 is representatively illustrated. In the method 60, the packer 10 is connected to primary and second tubing strings 62, 64. For example, the primary string 62 may be a production string and the secondary string 64 may be an injection string. The tubing strings 62, 64 are connected to the mandrel 20, so that the flow passages 12, 14, respectively, extend through the tubing strings.

As illustrated in FIGS. 5A–D, the packer 10 and tubing strings 62, 64 have been conveyed into a wellbore 66, and the packer has been set in the wellbore. The slips 16 are grippingly engaged with casing 68 lining the wellbore 66, and the seal elements 18 are sealingly engaged with the casing. Note that it is not necessary in keeping with the principles of the invention for the wellbore 66 to be lined with casing 68, since the method 60 may also be practiced in uncased wellbores.

Figure 5A:
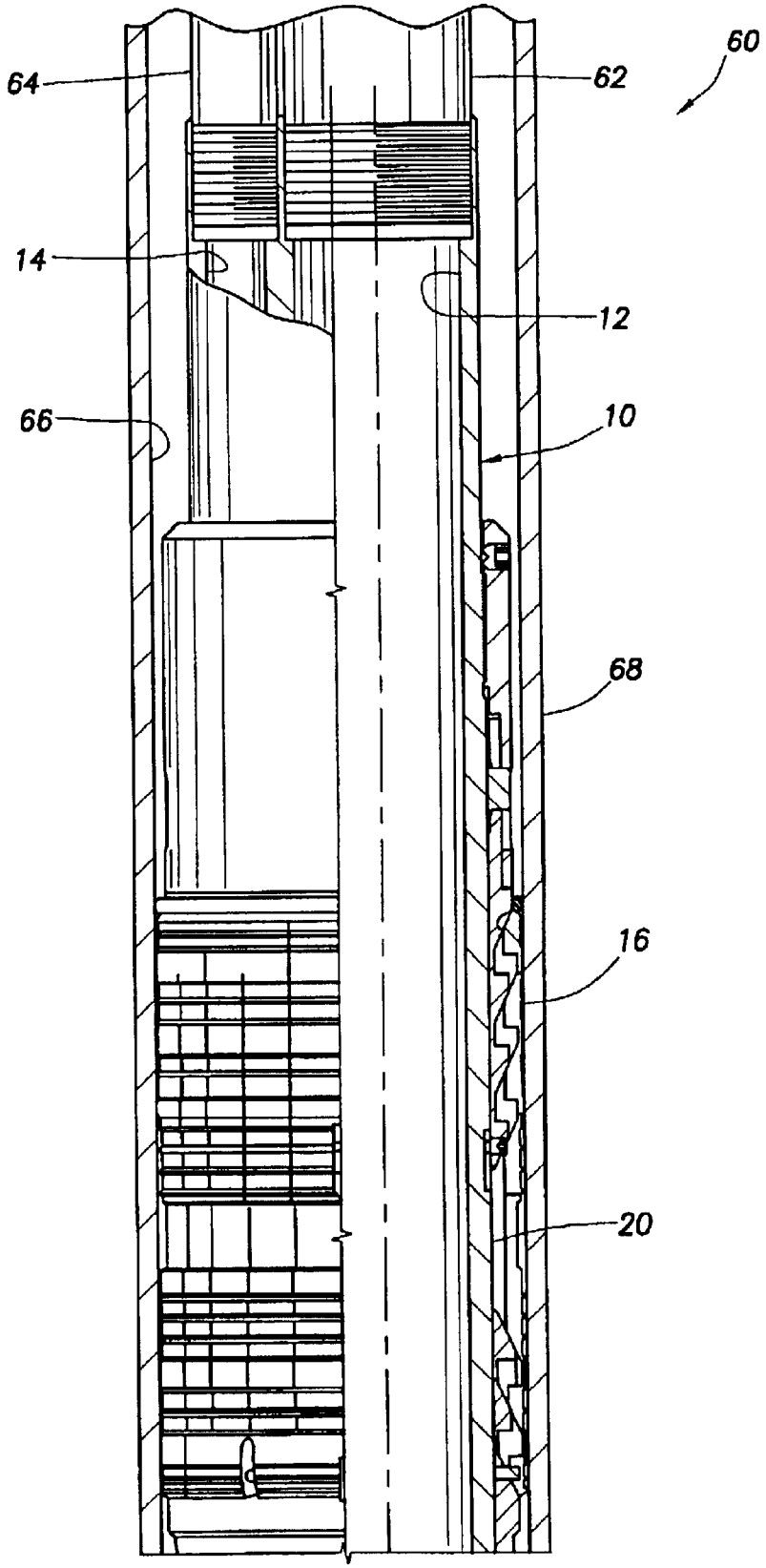
FIGS. 5A–D are successive axial portions of a cross-sectional view of the packer, wherein additional steps of the first method have been performed.
Figure 5B:
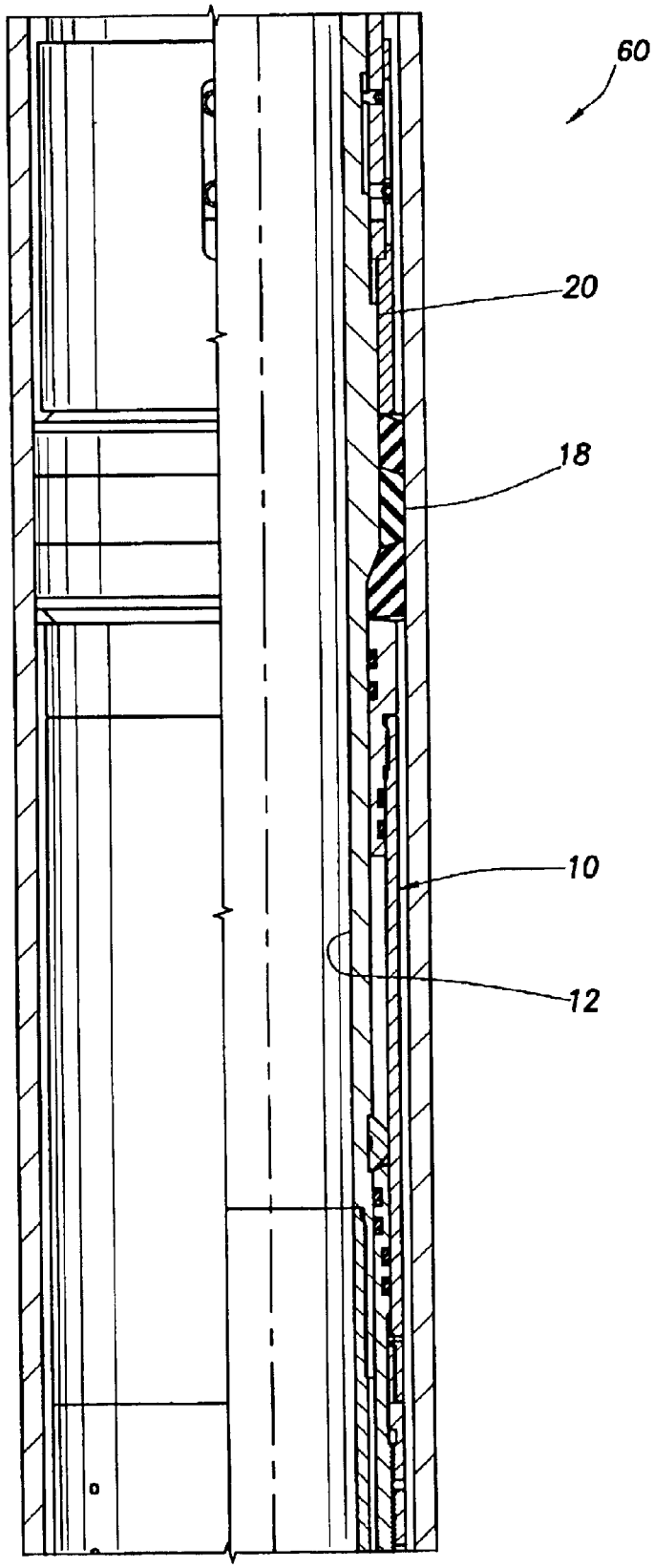
Figure 5C:
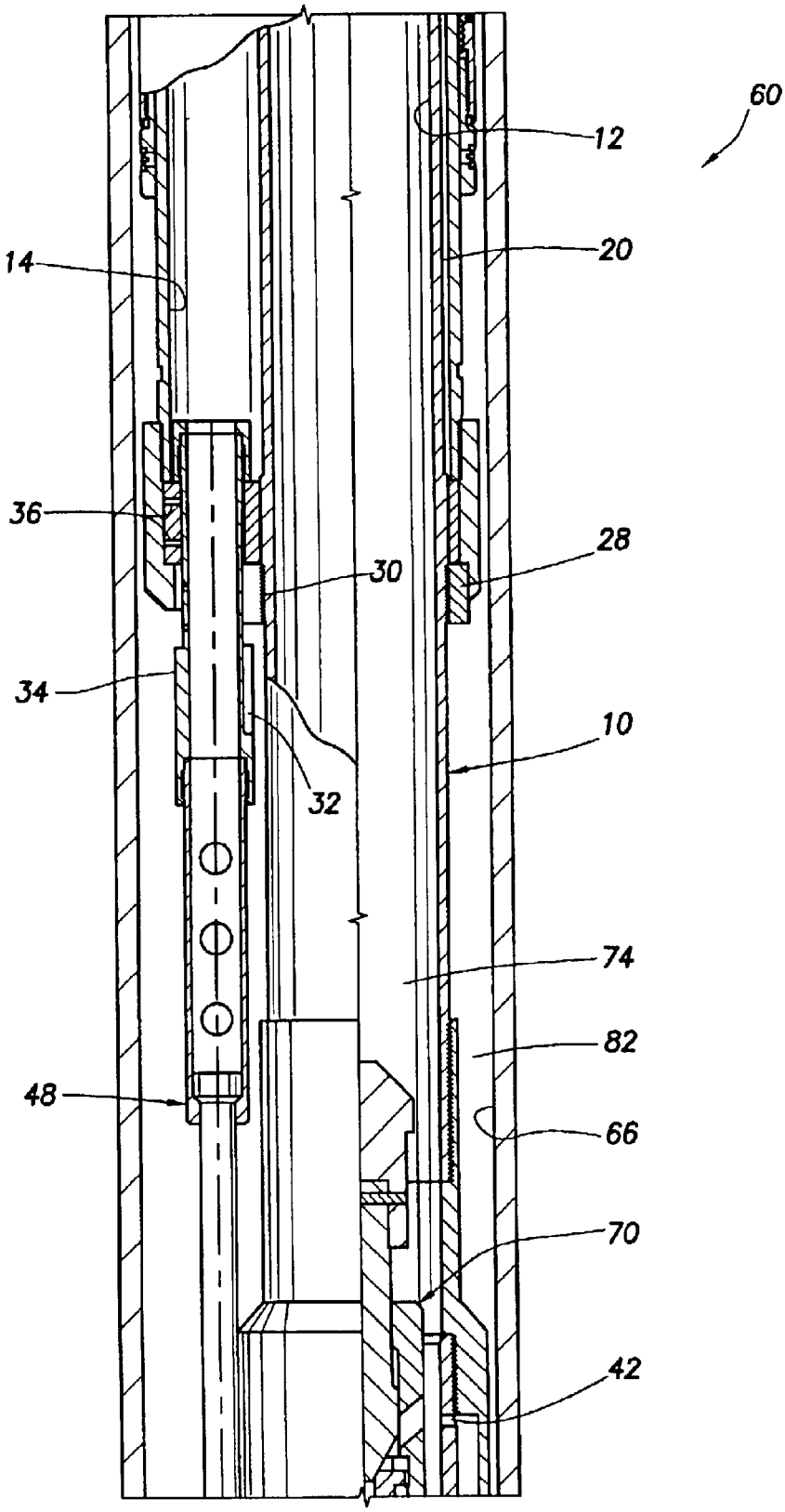
Figure 5D:
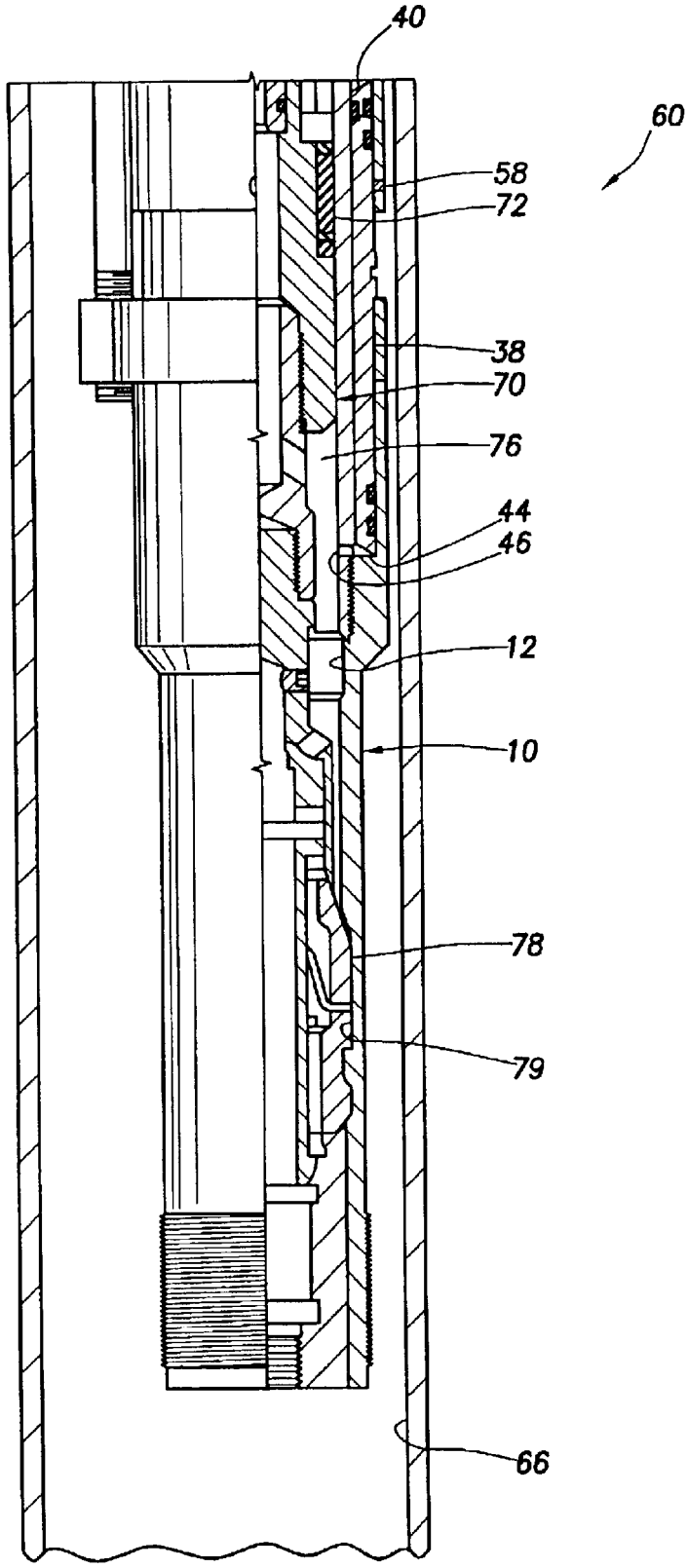
Figure 6A:
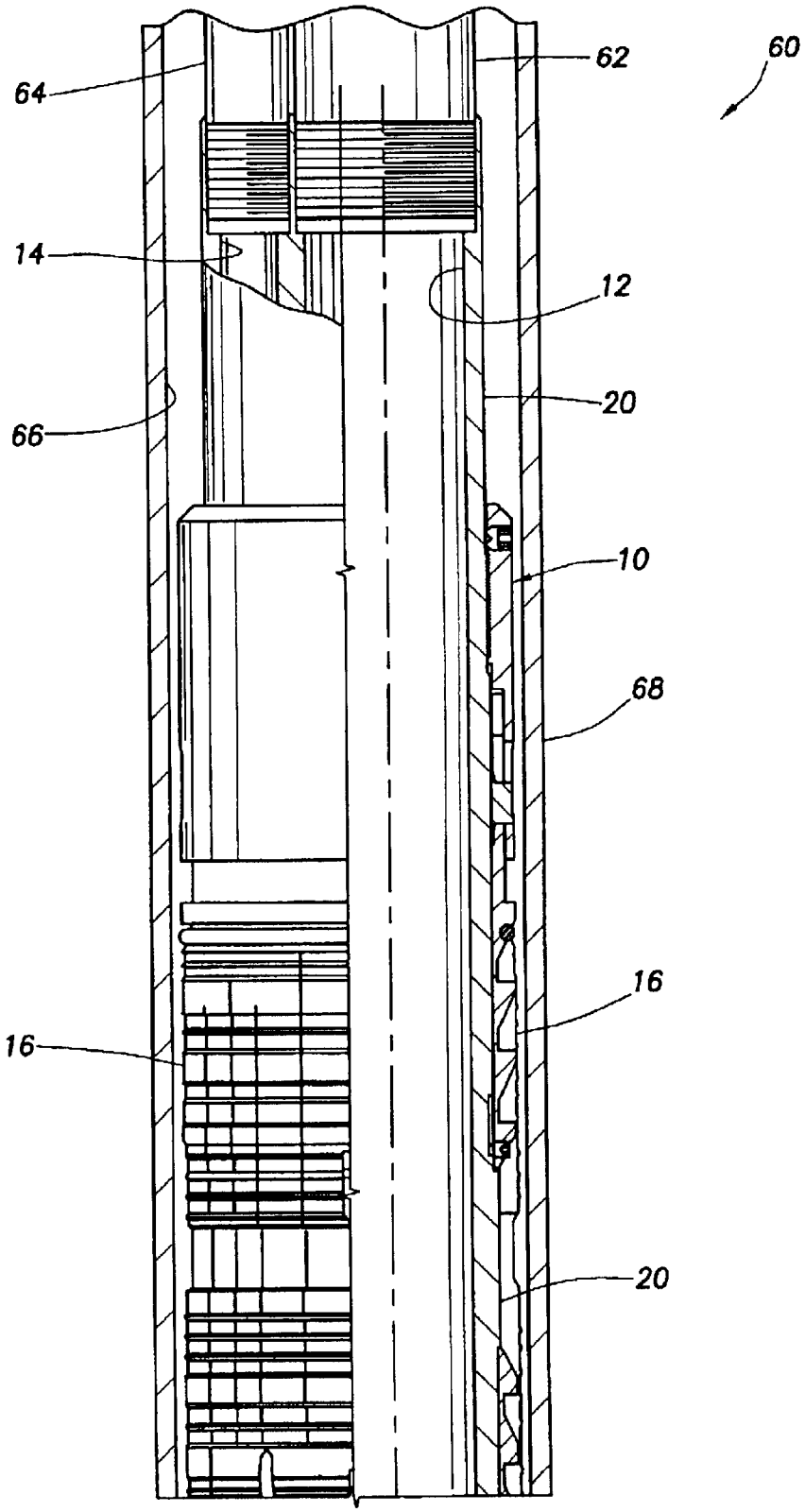
FIGS. 6A–D are successive axial portions of a cross-sectional view of the packer, wherein further steps of the first method have released the packer.
Figure 6B:
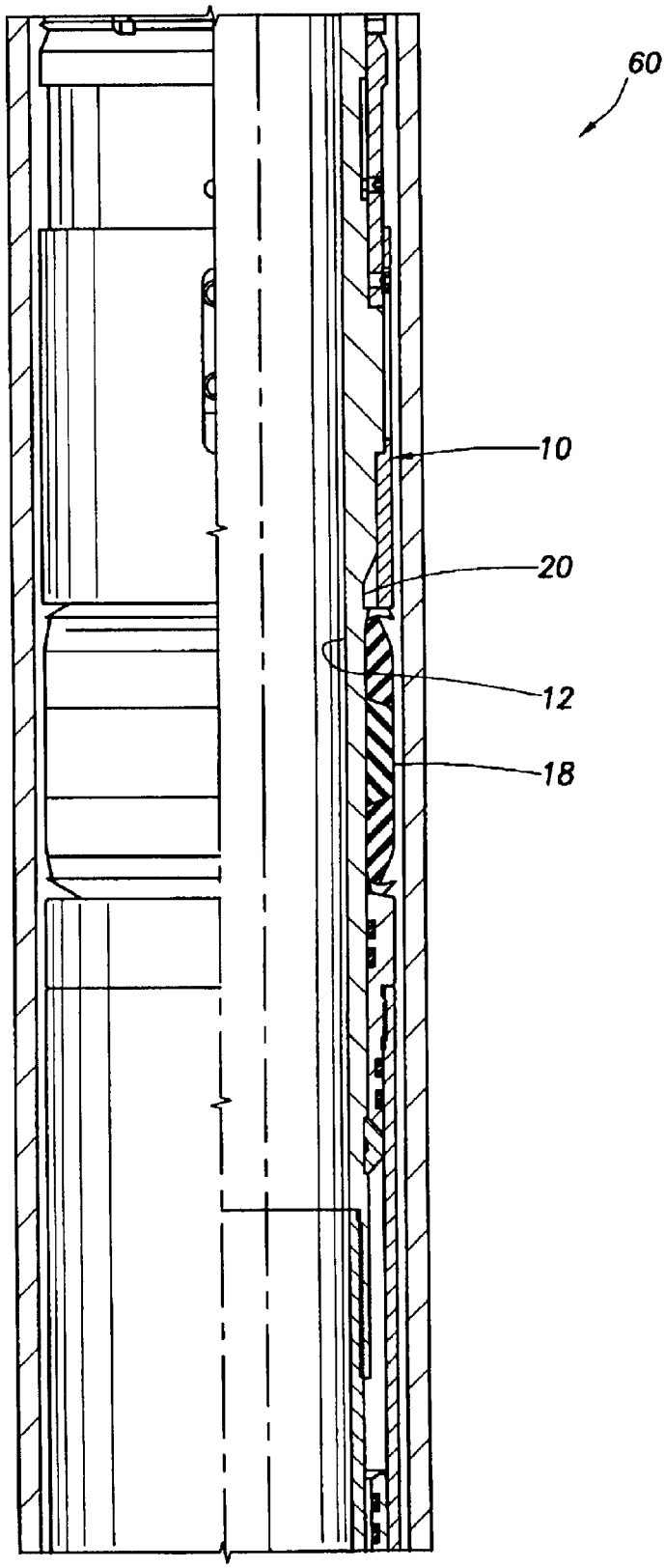
Figure 6C:
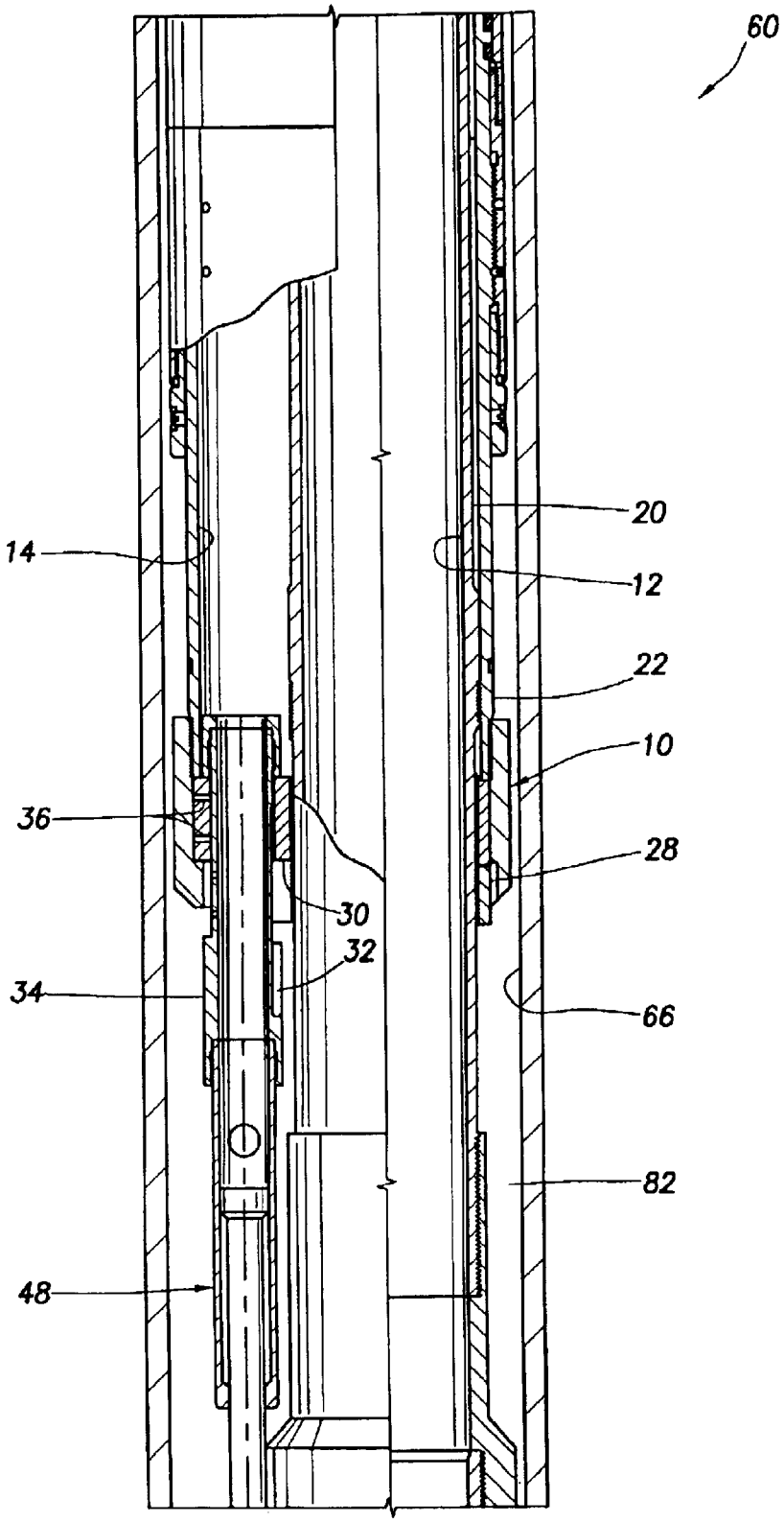
Figure 6D:
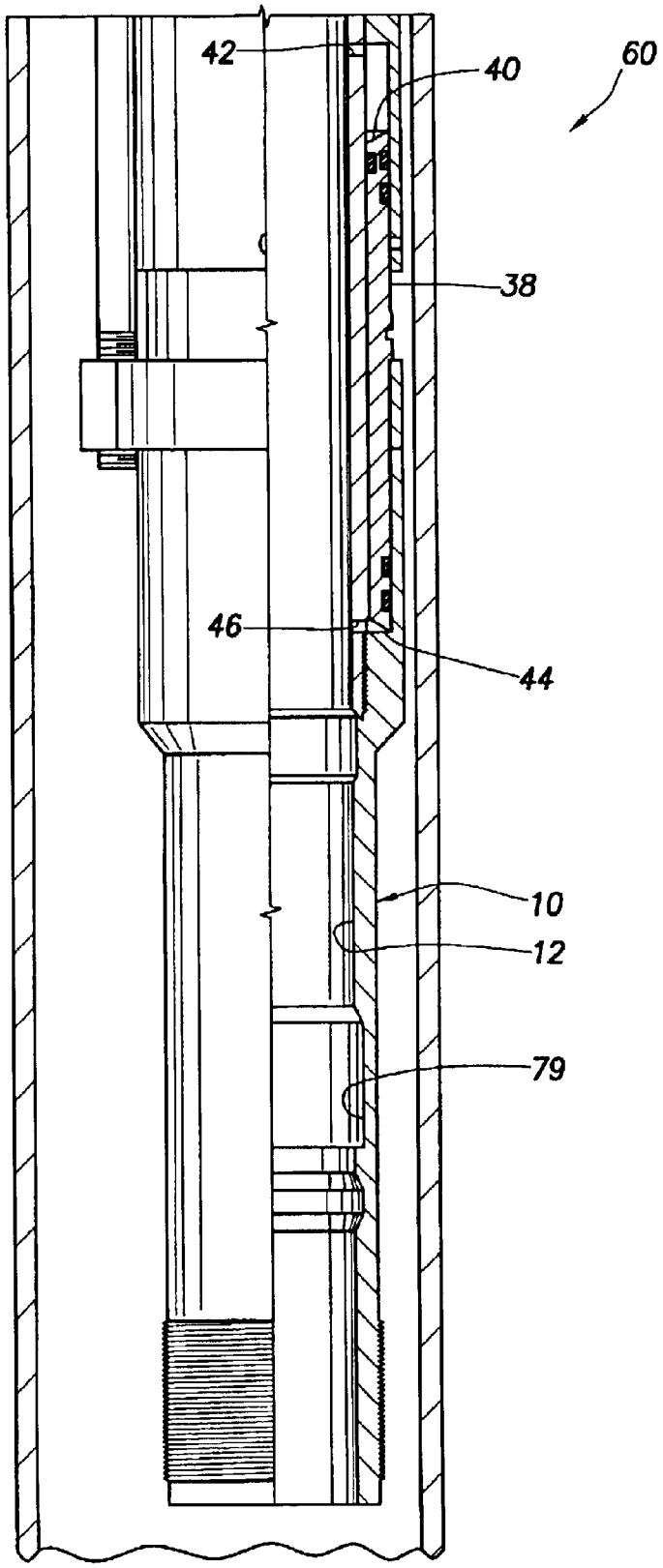

As depicted in FIGS. 5C&D, a plug 70 conveyed through the primary flow passage 12 is sealingly engaged in the primary flow passage. For example, the plug 70 may be conveyed through the flow passage 12 by wireline, coiled tubing, pumping the plug down the primary string 62, etc. Seals 72 carried on the plug 70 seal against the flow passage 12 between the ports 42, 46, thereby isolating an upper portion 74 of the primary flow passage 12 in communication with the upper side 40 of the piston 38 via the port 42 from a lower portion 76 of the flow passage in communication with the lower side 44 of the piston via the port 46.

To ensure accurate positioning of the seals 72 between the ports 42, 46, a latch or other anchoring device 78 of the plug 70 engages an internal no-go profile 79 formed in the flow passage 12. Other anchoring and positioning means may be used for positioning the seals 72 so that they isolate the upper flow passage portion 74 from the lower flow passage portion 76, without departing from the principles of the invention.

Pressure in the upper flow passage portion 74 is communicated to the upper side 40 of the piston 38, while pressure in the lower flow passage portion 76 is communicated to the lower side 44 of the piston, and each is isolated from the other, when the plug 70 has been installed. The pressure differential may be applied across the piston 38 to bias it downwardly by increasing pressure in the upper passage portion 74, for example, by applying pressure to the primary tubing string 62 at a remote location, such as by using a pump at the earth's surface. Of course, the piston 38 could alternatively be biased downwardly by applying the pressure differential in another manner, such as by decreasing pressure in the lower passage portion 76.

As depicted in FIGS. 5A–D. pressure has been applied to the upper flow passage portion 74 after installing the plug 70, thereby applying the pressure differential across the piston 38. The downwardly biasing force due to the pressure differential acting on the piston 38 has caused the shear screws 58 to shear, permitting the downwardly biasing force to be transmitted to the retaining device 34 via the coupling 48. The downwardly biasing force has also caused the shear pins 36 to shear, permitting the retaining device 34 to displace downwardly, thereby releasing the packer 10.

Thus, in addition to being releasable by severing the mandrel 20, the packer 10 is releasable by installing the plug 70 and applying the pressure differential across the piston 38. In FIGS. 6A–D, the packer 10 is representatively illustrated after releasing. The outer assembly 22 has displaced downwardly relative to the mandrel 20, due to the retaining ring 28 being permitted to expand outward by displacement of the retaining device 34. Note that the slips 16 are now relieved from gripping engagement with the casing 68, and the seal elements 18 are relieved from sealing engagement with the casing.

Figure 7:
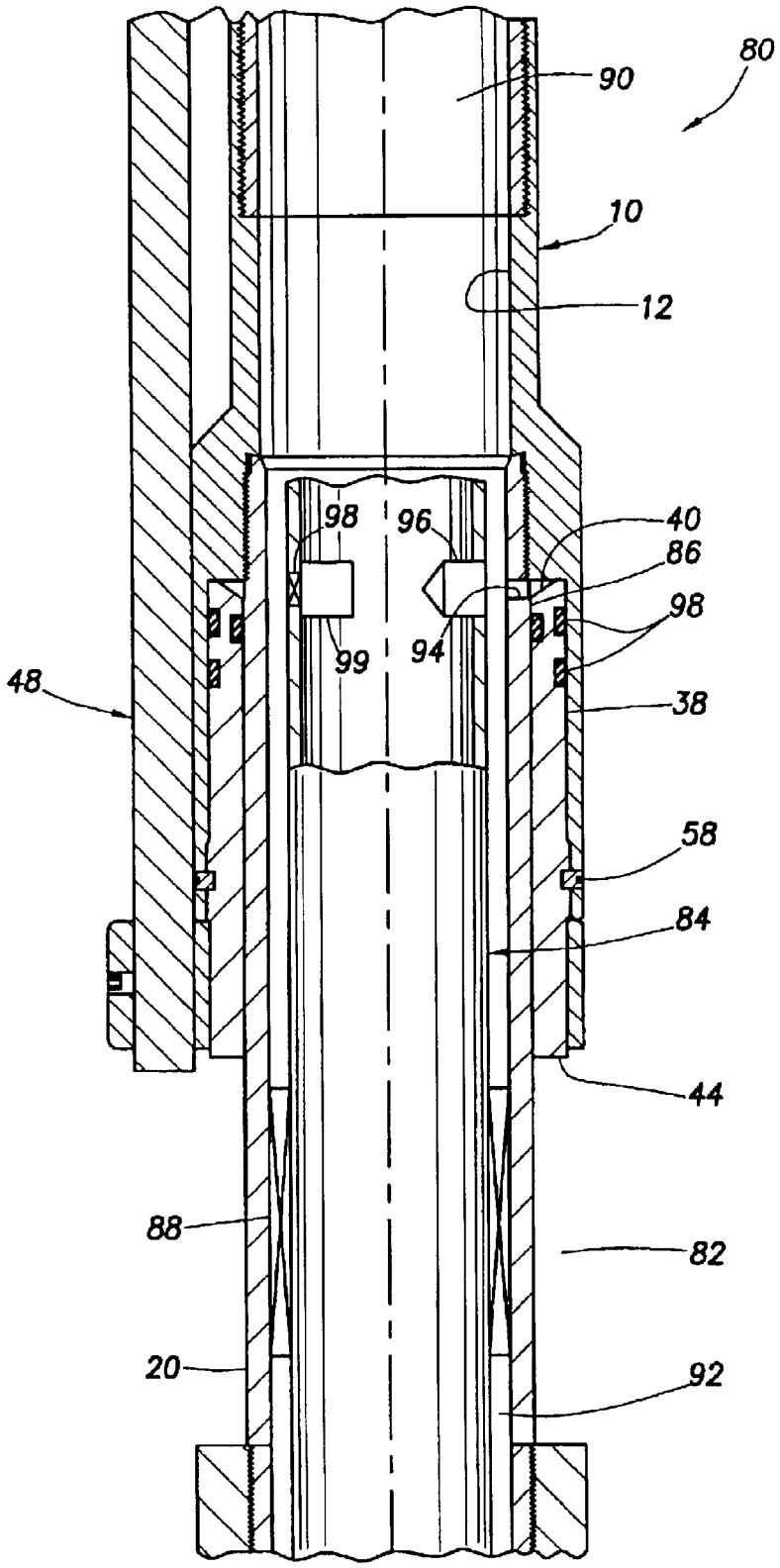
FIG. 7 is a cross-sectional view of an axial portion of the packer and a second releasing method embodying principles of the invention.

Referring additionally now to FIG. 7, another method 80 of releasing the packer 10 is representatively illustrated. In this method 80, the piston 38 has been modified so that its lower piston area or side 44 is in communication with the exterior of the packer 10. When the packer 10 is installed in a wellbore, the exterior of the packer corresponds to an annulus 82 formed between the packer and the wellbore 66.

Figure 1E:
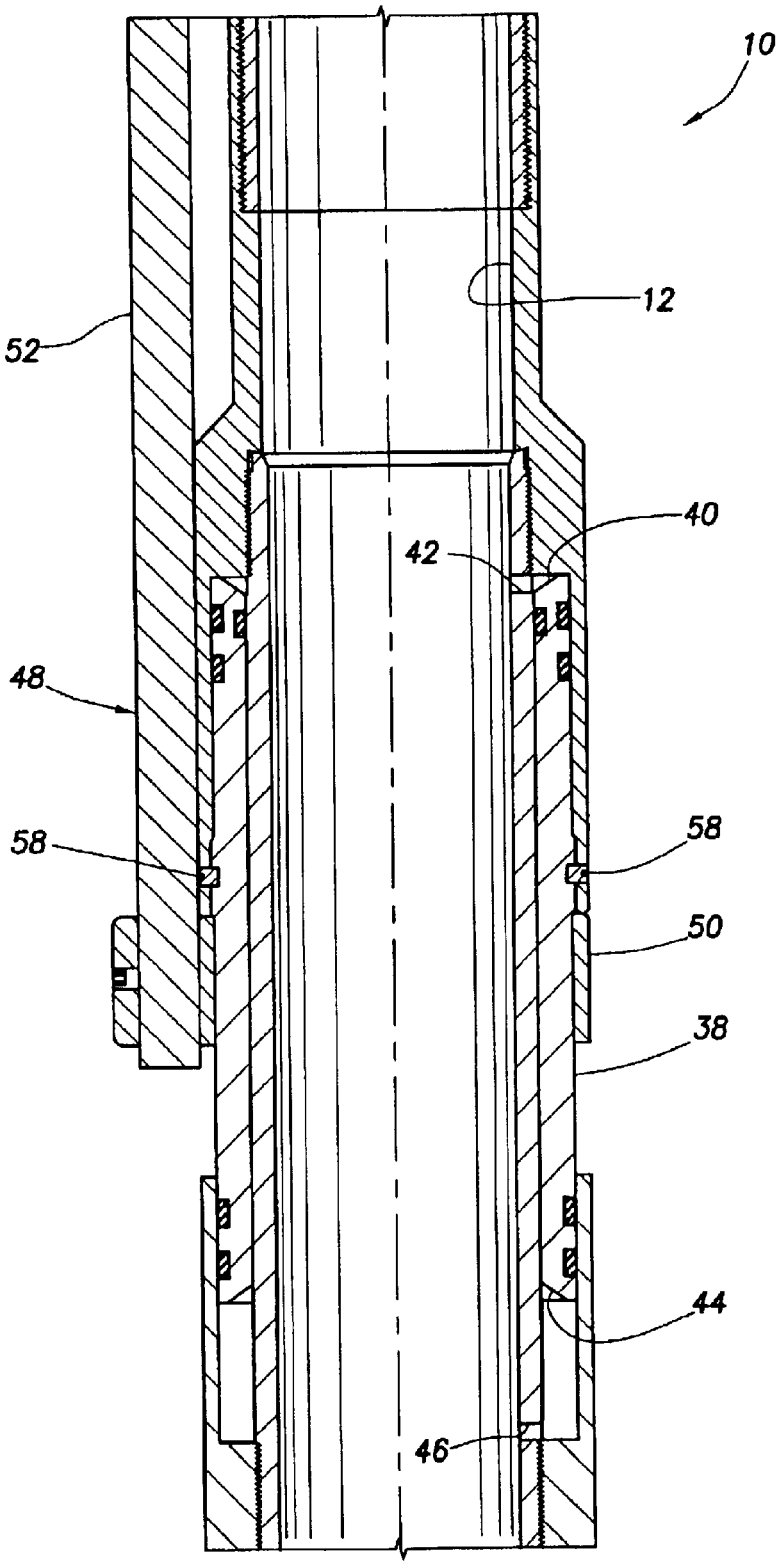
Figure 1F:
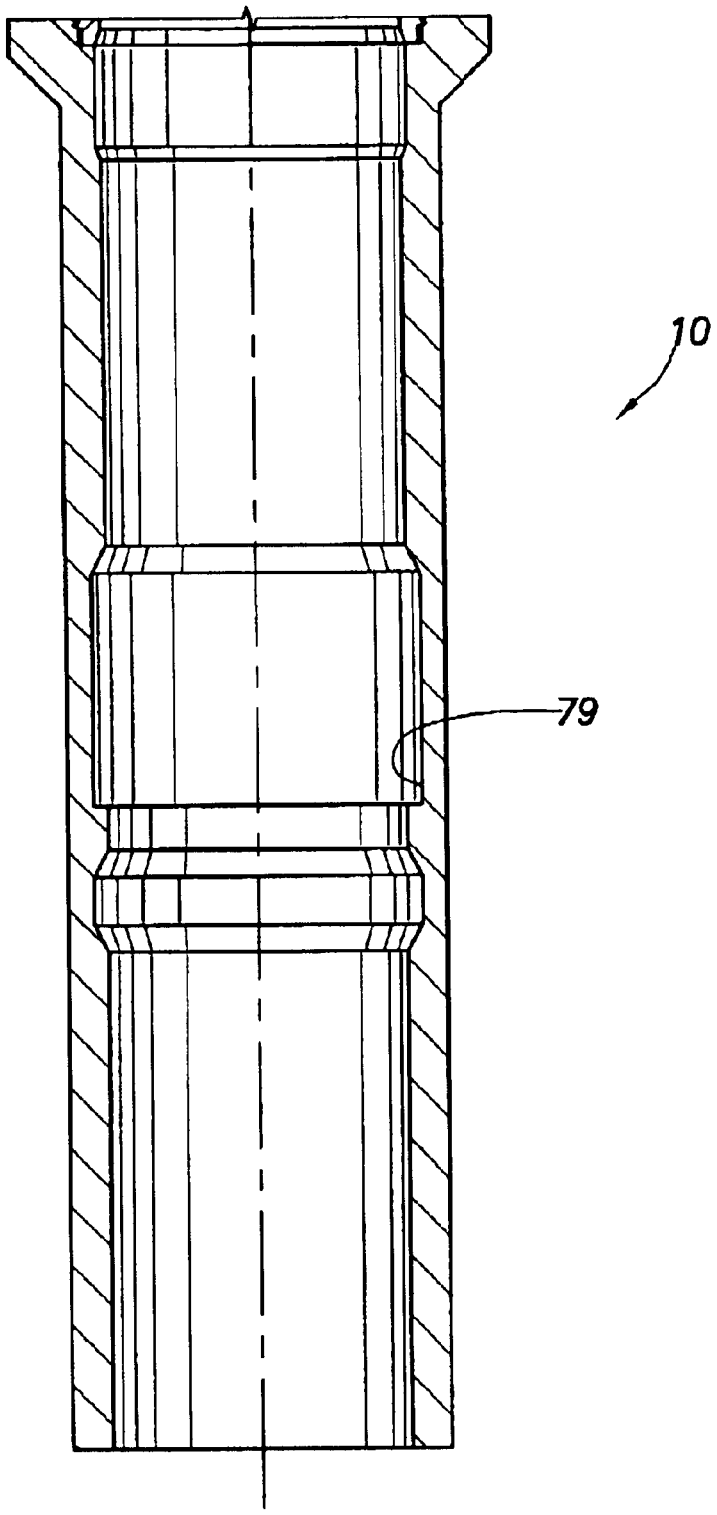

In addition, in the method 80 illustrated in FIG. 7, the port 40 shown in FIG. 1E does not initially exist as described for the method 6o above. Instead, in the method 80, the upper side 40 of the piston 38 is initially isolated from the primary flow passage 12 by a barrier 86. As illustrated in FIG. 7, the barrier 86 is a sidewall of the mandrel 20.

The upper side 40 of the piston 38 may be placed in fluid communication with the primary flow passage 12 by conveying a perforating device 84 through the flow passage and into the packer 10 as depicted in FIG. 7. The perforating device 84 includes a plug 88 for sealing engagement in the primary flow passage 12 and isolating an upper portion 90 of the flow passage from a lower portion 92 of the flow passage.

The perforating device 84 may be accurately positioned relative to the packer 10 by using an anchoring device, such as the anchoring device 78 described above, attached to the perforating device.

An opening 94 is formed through the sidewall 86 of the mandrel 20 by firing a shaped charge 96 of the perforating device 84. Alternatively, the opening 94 may be formed by chemically cutting through the barrier, for example, by opening a valve 98 to release a chemical from a container 99 of the perforating device 84. Other methods of forming the opening 94 may be used in keeping with the principles of the invention.

It will now be appreciated that, with the opening 94 formed, a downwardly biasing force may be applied to the piston 38 by increasing the pressure in the upper portion 90 of the primary flow passage 12 relative to pressure in the annulus 82. For example, pressure may be applied to the primary tubing string 62 at a remote location, such as by using a pump at the earth's surface. When a sufficiently great downwardly biasing force is applied to the piston 38 by the pressure differential, the shear screws 58 shear, the downwardly biasing force is transmitted by the coupling 48 to the retaining device 34, and the packer 10 is released, similar to the manner in which the packer is released in the method 60 described above.

Note that the modified piston 38 could be substituted for the piston illustrated in FIG. 1E in the method 60. That is, the packer 10 used in the method 60 could be configured as illustrated in FIG. 7, so that the piston 38 displaces in response to a pressure differential between the primary flow passage 12 and the annulus 82. The port 42 could be initially provided (and the port 46 eliminated) in the method 60, so that the upper side 40 of the piston 38 is initially in fluid communication with the upper portion 90 of the primary flow passage 12. Alternatively, an opening, such as the opening 94 illustrated in FIG. 7, could be formed after the packer 10 is set in the wellbore 66.

As another alternative, the perforating device 84 could be used in the packer 10 illustrated in FIGS. 1A–F, that is, in the packer configured so that the piston 38 displaces in response to a pressure differential applied between isolated portions 74, 76 of the primary flow passage 12. In this alternative, the perforating device 84 could be used to form one or both of the ports 42, 46 when it is desired to apply the pressure differential to the piston 38 to release the packer 10.

An advantage of forming the ports 42, 46 or opening 94 after the packer 10 is set in the wellbore 66 and when it is desired to release the packer, is that this prevents exposure of the piston 38 and its seals 98 to fluid in the primary flow passage 12. Until the piston 38 and seals 98 are exposed to fluid in the flow passage 12, the barrier 86 provides increased reliability in isolating the flow passage from the annulus 82.

Figure 8:
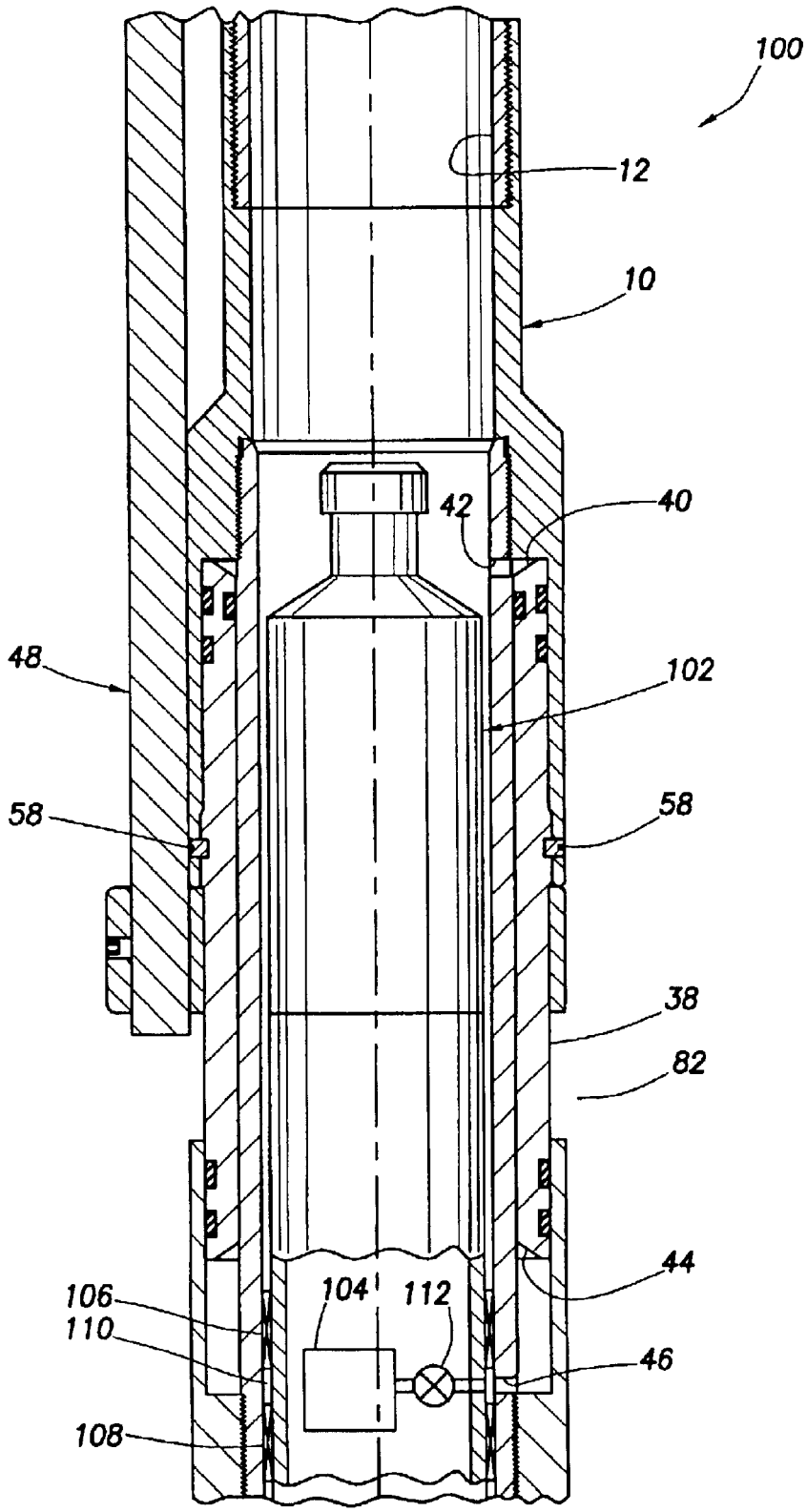
FIG. 8 is a cross-sectional view of an axial portion of the packer and a third releasing method embodying principles of the invention.

Referring additionally now to FIG. 8, another method 100 of releasing the packer 10 is representatively illustrated. In the method 10, a device 102 including a pressure chamber 104 is conveyed into the primary flow passage 12. The device 102 may be anchored in position relative to the packer 10 as depicted in FIG. 8 by using an anchoring device, such as the anchoring device 78 described above, attached to the device 102.

The device 102 includes seals 106, 108 which sealingly engage the flow passage 12 straddling the lower port 46. The seals 106, 108 isolate an annular portion 110 of the flow passage 12 from the remainder of the flow passage. The annular passage portion 110 is in fluid communication with the lower port 46. When a valve 112 is opened, the lower side 44 of the piston 38 is placed in fluid communication with the pressure chamber 104.

The pressure chamber 104 may contain, for example, air at atmospheric pressure. In this example, opening the valve 112 will cause a reduction in the pressure applied to the lower side 44 of the piston 38, increasing the differential between the pressure in the remainder of the flow passage 12 applied via the upper port 42 to the upper side 40 of the piston and the pressure in the annular portion 110 of the flow passage. This increased pressure differential applies a downwardly biasing force to the piston 38.

When the downwardly biasing force is sufficiently great, the shear screws 58 will shear, thereby transmitting the force to the retaining device 34 via the coupling 48. The shear pins 36 will also shear when the sufficiently great downwardly biasing force is applied to the retaining device 34, the retaining device will displace downwardly, and the packer 10 will be released as described above.

In the above description of the method 100, the chamber 104 contains pressure less than that in the flow passage 12 in order to create a pressure differential across the piston 38. Alternatively, the chamber 104 could contain pressure greater than that in the flow passage 12, and could be applied to the piston 38 via the upper port 42 while the lower port 46 remains in fluid communication with the flow passage, to thereby apply the pressure differential across the piston. In that case, the seals 106, 108 would be positioned straddling the upper port 42.

Although the piston 38 is depicted in FIG. 8 as being responsive to a pressure differential applied from the flow passage 12, it will be appreciated that the piston could be responsive to a pressure differential applied between the flow passage and the annulus 82 (as depicted in FIG. 7), or the piston could be responsive to otherwise applied pressure differentials, without departing from the principles of the invention.

Although in the method 100 the ports 42, 46 are already formed when the device 102 is conveyed into the packer 10, it will be appreciated that a device, such as the perforating device 84 described above, could be used to form one or both of the ports prior to applying the pressure differential in the method. Other means of providing fluid communication with the piston 38 may be used in keeping with the principles of the invention.

Figure 9A:
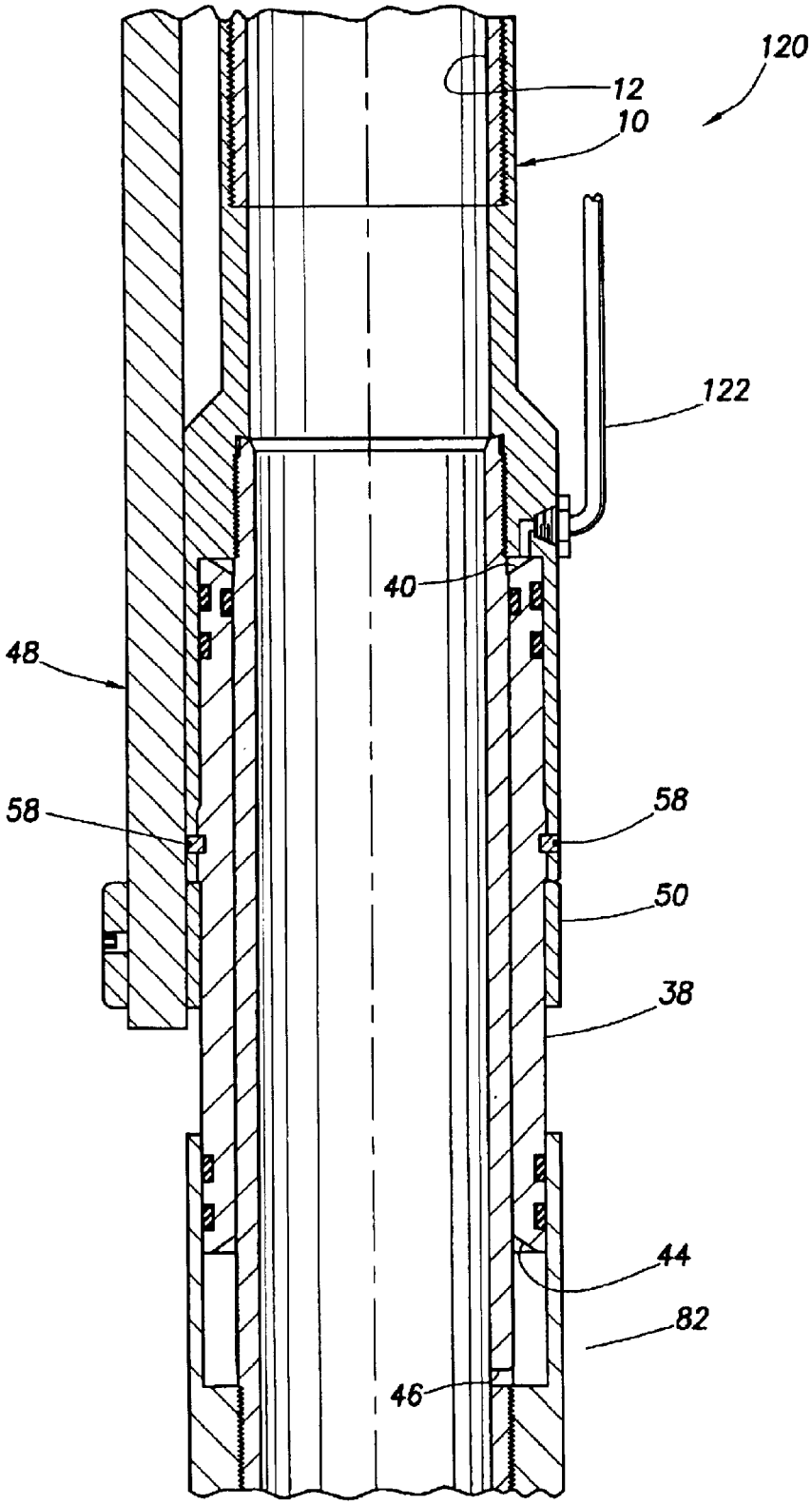
FIGS. 9A&B are cross-sectional views of axial portions of the packer and a fourth releasing method embodying principles of the invention.

Referring additionally now to FIGS. 9A&B, another method 120 of releasing the packer 10 is representatively illustrated. In the method 120, the piston 38 is responsive to a pressure differential between a control line 122 and the flow passage 12. Pressure is applied to the upper side 40 of the piston 38 through the control line 122, and pressure is applied to the lower side 44 of the piston via the lower port 46. Note that the upper port 42 is eliminated in this modified construction of the packer 10 used in the method 120.

The control line 122 is depicted in FIG. 9A as being separately and externally connected to the packer 10. For example, the control line 122 could extend to a remote location, such as the earth's surface. However, the control line 122 could be internally formed in the packer 10, and could be integrally formed with another structure of the packer. For example, in FIG. 9B, an upper portion of the control line 122 is depicted as being internally formed, and integrally formed in the mandrel 20.

To release the packer 10, pressure is applied to the control line 122 to create a pressure differential between the control line and the flow passage 12. Pressure may be applied to the control line 122 at a remote location, such as by using a pump at the earth's surface. This pressure differential results in a downwardly biasing force being applied to the piston 38.

When the downwardly biasing force is sufficiently great, the shear screws 58 will shear, thereby transmitting the force to the retaining device 34 via the coupling 48. The shear pins 36 will also shear when the sufficiently great downwardly biasing force is applied to the retaining device 34, the retaining device will displace downwardly, and the packer 10 will be released as described above.

Figure 9B:
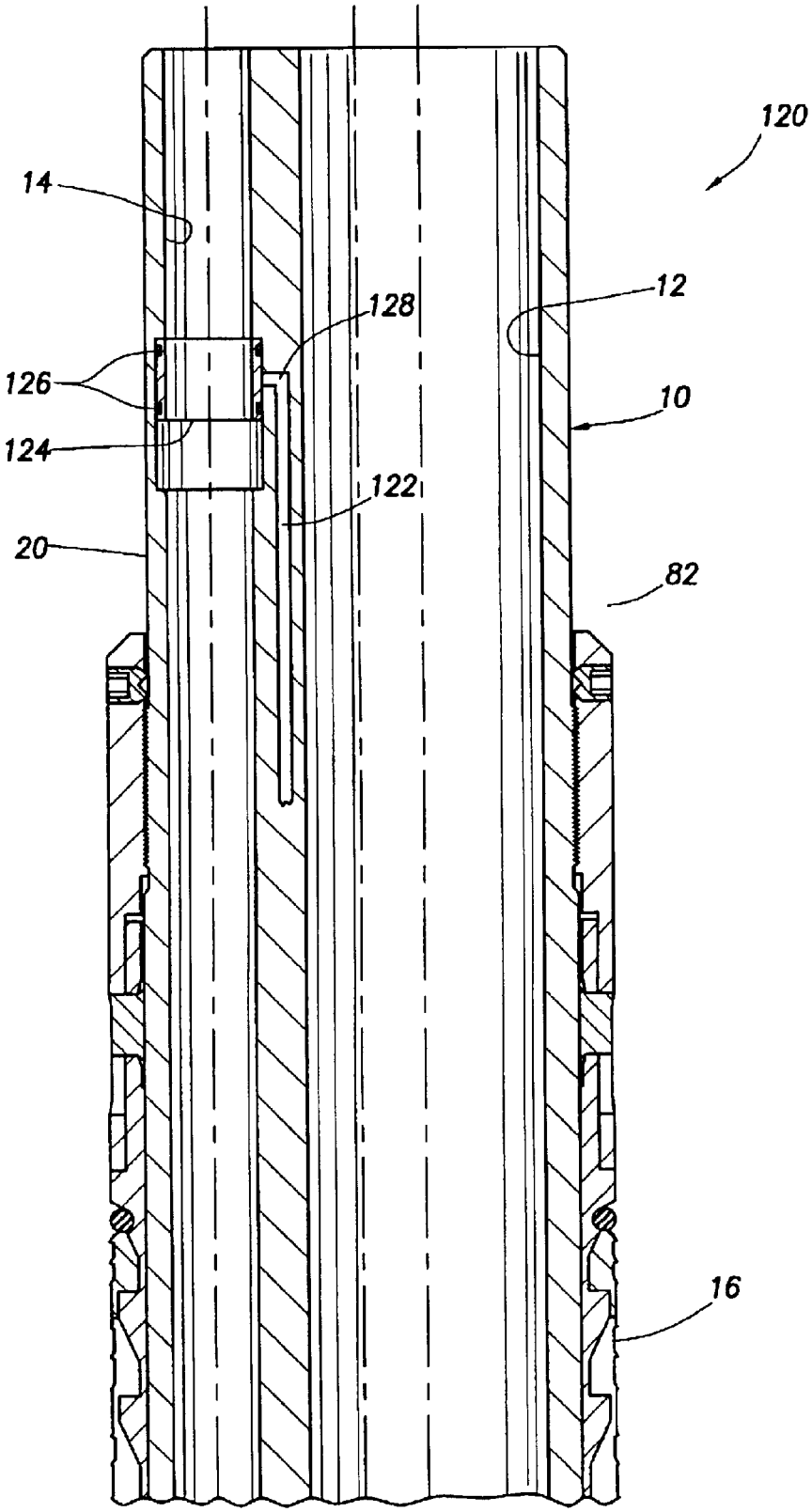

Instead of extending the control line 122 to a remote location, such as the earth's surface, in order to apply pressure to the control line, an alternative is depicted in FIG. 9B. In this alternative of the method 120, the control line 122 extends to the secondary flow passage 14, extending internally in the mandrel 20. Fluid communication between the control line 122 and the flow passage 14 is initially prevented by a sleeve 124 or other member in the flow passage.

The sleeve 124 has seals 126 which initially straddle a port 128 extending from the control line 122 to the flow passage 14. By displacing the sleeve 124 downward, the port 128 may be exposed to the flow passage 14, thereby providing fluid communication between the flow passage and the control line 122. The sleeve 124 may be displaced downward using a variety of methods, such as by using a wireline or coiled tubing conveyed shifting tool, providing a differential piston area on the sleeve and applying pressure to the flow passage 14 to apply a biasing force to the sleeve, etc.

Furthermore, other means of providing selective fluid communication between the flow passage 14 and the control line 122, for example, a kobe or break plug, or a perforating device such as the perforating device 84, may be used without departing from the principles of the invention.

After the control line 122 is placed in fluid communication with the flow passage 14, pressure applied to the secondary tubing string 64 at a remote location, such as the earth's surface, is applied to the top side 40 of the piston 38. By applying a sufficiently great pressure differential between the control line 122 and the flow passage 12, the piston 38 may be displaced downwardly to release the packer 10 as described above.

Although the piston 38 is depicted in FIG. 9A as being responsive to a pressure differential applied between the control line 122 and the flow passage 12, it will be appreciated that the piston could be responsive to a pressure differential applied between the control line and the annulus 82 (as depicted in FIG. 7), or the piston could be responsive to otherwise applied pressure differentials, without departing from the principles of the invention.

Although in the method 120 the port 46 is already formed when the packer 10 is installed in the wellbore 66, it will be appreciated that a device, such as the perforating device 84 described above, could be used to form the port prior to applying the pressure differential in the method. Other means of providing fluid communication with the piston 38 may be used in keeping with the principles of the invention.

Figure 10:
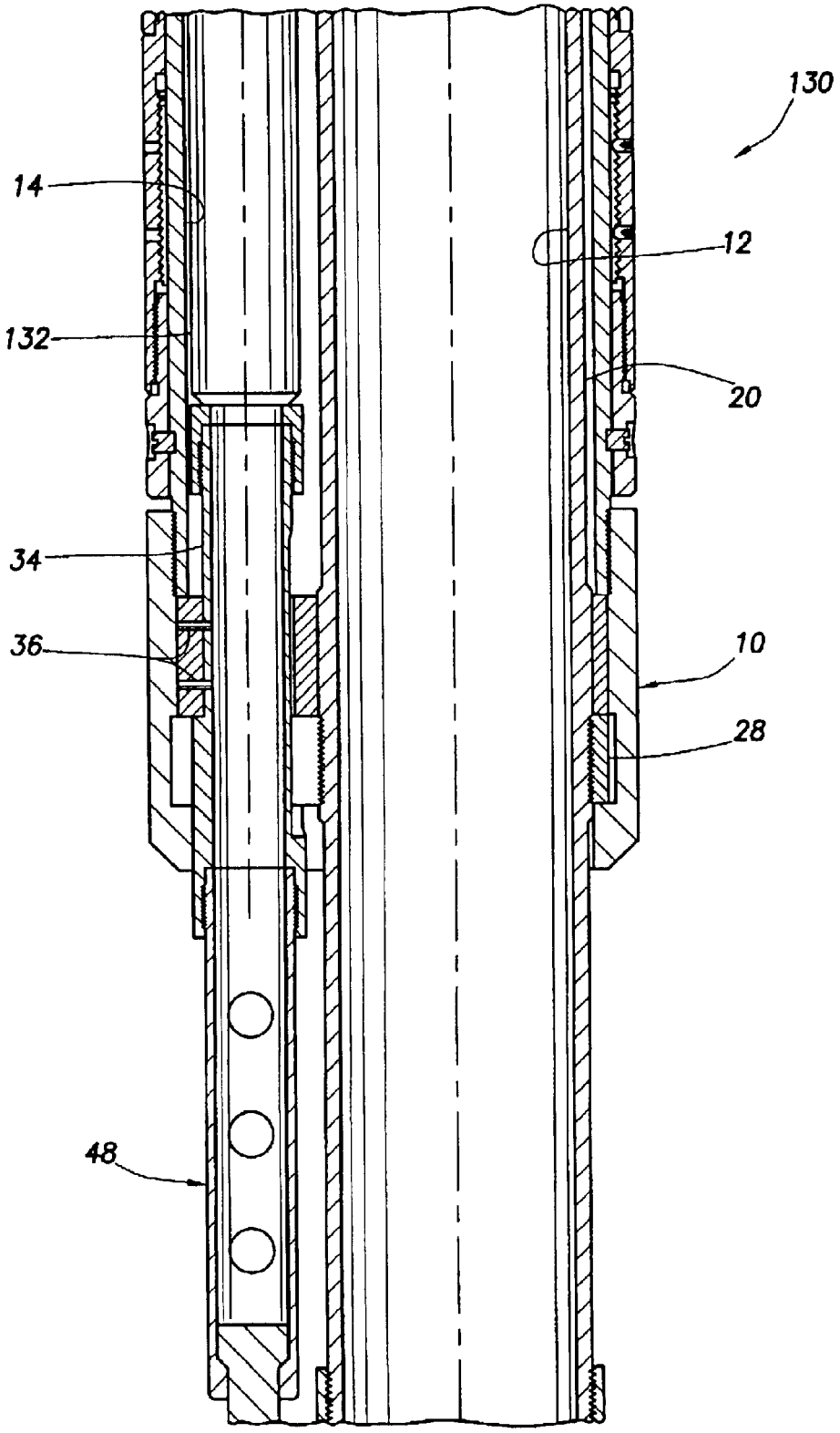
FIG. 10 is a cross-sectional view of an axial portion of the packer and a fifth releasing method embodying principles of the invention.

Referring additionally now to FIG. 10 another method 130 of releasing the packer 10 is representatively illustrated. In the method 130, a displacement device or structure 132 is conveyed through the flow passage 14 to apply a downwardly directed force to the retaining device 34. The structure 132 may be any structure suitable for this purpose. For example, the structure 132 may be a drop bar which is dropped through the secondary tubing string 64 to impact the retaining device 34. The structure 132 could be the lower end, such as a blind box, of a wireline conveyed jarring assembly.

When a sufficiently great downwardly directed force is applied by the structure 132 to the retaining device 34, the shear pins 36 will shear. The retaining device 34 will then displace downwardly, permitting the retaining ring 28 to expand, and thereby releasing the packer 10 as described above. The coupling 48 permits the retaining device 34 to displace downwardly, without the piston 38 also displacing.

Note that this method 130 of releasing the packer 10 does not require application of pressure to the packer, and does not require entry into the primary flow passage 12.

Figure 11:
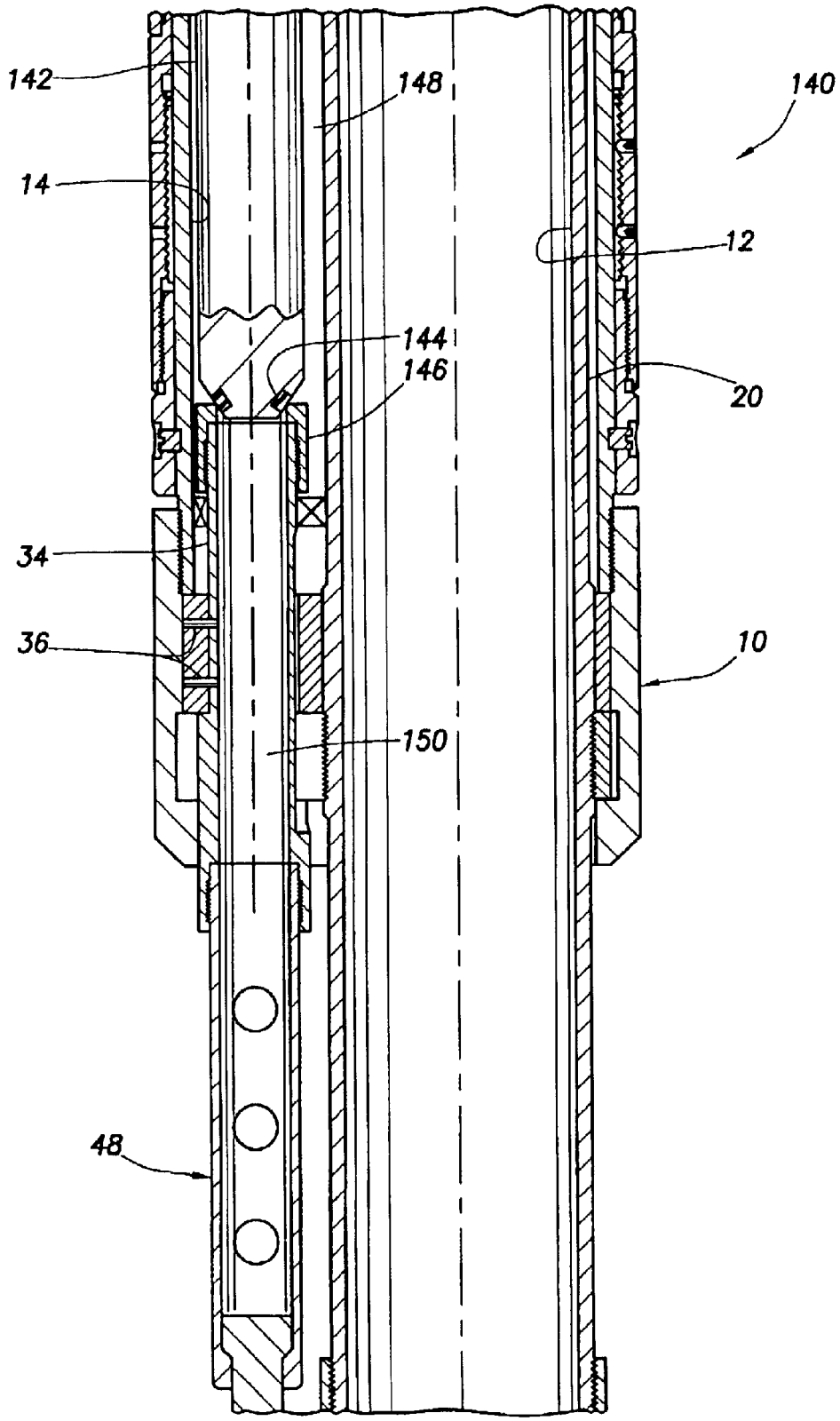
FIG. 11 is a cross-sectional view of an axial portion of the packer and a sixth releasing method embodying principles of the invention.

Referring additionally now to FIG. 11, another method 140 of releasing the packer 10 is representatively illustrated. In this method 140, the displacement device 142 conveyed through the flow passage 14 for engagement with the retaining device 34 actually seals against the retaining device, so that a pressure differential may be created thereacross.

A seal 144 carried on the displacement device 142 sealingly engages an upper tubular cap 146 of the retaining device 34. The seal 144 may be an elastomer, metal to metal, or any other type of seal, and it may be integrally formed on the displacement device.

When the seal 144 engages the cap 146, an upper portion 148 of the flow passage 14 is effectively isolated from a lower portion 150 of the flow passage. In this embodiment, the retaining device 34 is sealed in the flow passage 14, for example, using a seal carried on the retaining device. A pressure differential may be created from the upper portion 148 to the lower portion 150 by applying pressure to the secondary tubing string 64 at a remote location, such as the earth's surface. This pressure differential acting across the retaining device 34 will bias the retaining device in a downward direction.

When a sufficiently great downwardly directed force is applied by the displacement device 142 to the retaining device 34, the shear pins 36 will shear. The retaining device 34 will then displace downwardly, permitting the retaining ring 28 to expand, and thereby releasing the packer 10 as described above. The coupling 48 permits the retaining device 34 to displace downwardly, without the piston 38 also displacing.

Figure 12:
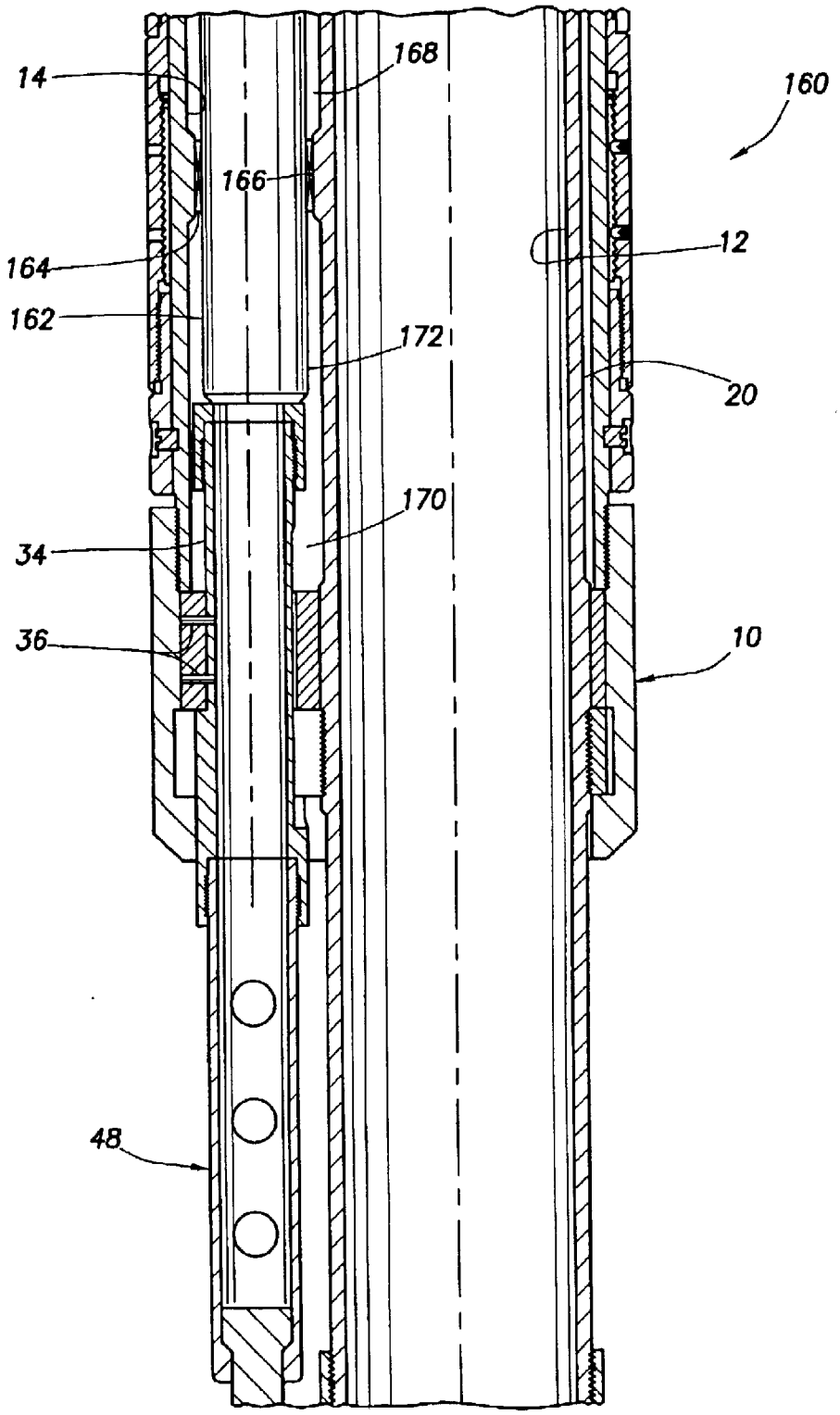
FIG. 12 is a cross-sectional view of an axial portion of the packer and a seventh releasing method embodying principles of the invention.

Referring additionally now to FIG. 12, another method 160 of releasing the packer 10 is representatively illustrated. In the method 160, a displacement device 162 carrying a seal 164 thereon is conveyed through the flow passage 14. The seal 164 sealingly engages a radially reduced seal bore 166 formed in the flow passage 14, thereby isolating an upper portion 168 from a lower portion 170 of the flow passage.

A lower end 172 of the device 162 contacts the retaining device 34. When a pressure differential is created from the upper flow passage portion 168 to the lower flow passage portion 170, the lower end 172 of the device 1662 applies a downwardly biasing force to the retaining device 34.

When a sufficiently great downwardly directed force is applied by the displacement device 162 to the retaining device 34, the shear pins 36 will shear. The retaining device 34 will then displace downwardly, permitting the retaining ring 28 to expand, and thereby releasing the packer 10 as described above. The coupling 48 permits the retaining device 34 to displace downwardly, without the piston 38 also displacing.

As the retaining device 34 displaces downwardly, the displacement device also displaces downwardly therewith. As a result, the seal 164 eventually leaves the seal bore 166. When the seal 164 is no longer sealed within the seal bore 166, the pressure differential applied between the upper and lower portions 168, 170 of the flow passage 14 will be relieved. If the pressure differential was applied by increasing pressure in the secondary tubing string 64, then this increased pressure will be relieved, thus providing a signal to the remote location that the displacement device 162 and the retaining device 34 have displaced downwardly in response to the differential pressure. For example, this signal may alert an operator at the earth's surface that no further pressure increase is to be applied, and that the packer 10 has been released.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of releasing a well tool set in a wellbore, the method comprising the steps of:

providing first and second flow passages extending longitudinally through the well tool and through first and second tubular strings connected to the respective first and second flow passages;

displacing a retaining device positioned at least partially in the second flow passage;

releasing the tool in response to the retaining device displacing step; and providing the well tool being releasable by displacing a piston in response to applying a pressure differential to the piston.

2. The method according to claim 1, wherein the retaining device displacing step is performed in response to a step of applying a pressure differential.

3. A method of releasing a well tool set in a wellbore, the method comprising the steps of:

providing first and second flow passages extending longitudinally through the well tool and through first and second tubular strings connected to the respective first and second flow passages;

displacing a retaining device positioned at least partially in the second flow passage, the retaining device displacing step being performed in response to a step of applying a pressure differential; and releasing the tool in response to the retaining device displacing step, the pressure differential applying step further comprising applying the pressure differential between the first and second flow passages.

4. The method according to claim 1, wherein the well tool providing step further comprises providing the piston encircling the first flow passage.

5. The method according to claim 1, wherein the retaining device displacing step is performed in response to the piston displacing step.

6. The method according to claim 5, further comprising the step of interconnecting a coupling device between the retaining device and the piston, thereby permitting displacement of the retaining device relative to the piston.

7. The method according to claim 6, wherein in the interconnecting step, the coupling device permits displacement of the retaining device in response to displacement of the piston.

8. The method according to claim 1, wherein the piston displacing step is performed in response to applying the pressure differential between the first and second flow passages.

9. The method according to claim 1, wherein the piston displacing step is performed in response to applying the pressure differential between the first flow passage and an annulus formed between the well tool and the wellbore.

10. The method according to claim 1, further comprising the step of providing the well tool which, in addition to being releasable in response to the retaining device displacing step, is also releasable by severing a tubular mandrel of the well tool.

11. The method according to claim 1, wherein the providing step further comprises providing the first and second flow passages integrally formed through a single mandrel of the well tool.

12. The method according to claim 1, further comprising the step of:

setting the well tool in the wellbore by forming a gripping engagement between the well tool and the wellbore, and wherein the releasing step further comprises releasing the gripping engagement.

13. The method according to claim 1, further comprising the step of:

setting the well tool in the wellbore by forming a sealing engagement between the well tool and the wellbore, and wherein the releasing step further comprises releasing the sealing engagement.

14. A method of releasing a well tool set in a wellbore, the method comprising the steps of:

providing first and second flow passages extending longitudinally through the well tool and through first and second tubular strings connected to the respective first and second flow passages;

displacing a retaining device positioned at least partially in the second flow passage, the retaining device displacing step being performed in response to a step of applying a pressure differential; and releasing the tool in response to the retaining device displacing step, the pressure differential applying step further comprising applying the pressure differential between one of the first and second flow passages and an annulus formed between the well tool and the wellbore.

15. A method of releasing a well tool set in a wellbore, the method comprising the steps of:

providing the well tool being releasable by severing an internal mandrel of the well tool;

setting the well tool in the wellbore; and releasing the well tool by applying a pressure differential to a piston of the well tool.

16. The method according to claim 15, wherein the piston displacing step is performed in response to applying the pressure differential between first and second flow passages extending through the well tool.

17. The method according to claim 15, wherein the piston displacing step is performed in response to applying the pressure differential between a flow passage extending through the well tool and an annulus formed between the well tool and the wellbore.

18. The method according to claim 15, wherein the providing step further comprises providing the well tool being releasable also by displacing a retaining device positioned at least partially in a flow passage formed longitudinally through the well tool.

19. The method according to claim 18, further comprising the step of forming multiple ones of the flow passage in a single internal mandrel of the tool.

20. The method according to claim 18, wherein the retaining device displacing step is performed in response to the piston displacing step.

21. The method according to claim 20, further comprising the step of interconnecting a, coupling device between the retaining device and the piston, thereby permitting displacement of the retaining device relative to the piston.

22. The method according to claim 21, wherein in the interconnecting step, the coupling device permits displacement of the retaining device in response to displacement of the piston.

23. The method according to claim 15, wherein the step of setting the well tool in the wellbore is performed by forming a gripping engagement between the well tool and the wellbore, and wherein the releasing step further comprises releasing the gripping engagement.

24. The method according to claim 15, wherein the step of setting the well tool in the wellbore is performed by forming a sealing engagement between the well tool and the wellbore, and wherein the releasing step further comprises releasing the sealing engagement.

25. A method of releasing a well tool set in a wellbore, the method comprising the steps of:

providing the well tool being releasable by severing an internal mandrel of the well tool;

setting the well tool in the wellbore; and releasing the well tool by displacing a retaining device positioned at least partially in a flow passage extending through the well tool, the providing step further comprising providing the well tool being releasable also by displacing a piston in response to applying a pressure differential to the well tool.

26. The method according to claim 25, further comprising the step of forming multiple ones of the flow passage in a single internal mandrel of the tool.

27. The method according to claim 25, wherein the piston displacing step is performed in response to applying the pressure differential between first and second flow passages extending through the well tool.

28. The method according to claim 25, wherein the piston displacing step is performed in response to applying the pressure differential between a flow passage extending through the well tool and an annulus formed between the well tool and the wellbore.

29. The method according to claim 25, wherein the step of setting the well tool in the wellbore is performed by forming a gripping engagement between the well tool and the wellbore, and wherein the releasing step further comprises releasing the gripping engagement.

30. The method according to claim 25, wherein the step of setting the well tool in the wellbore is performed by forming a sealing engagement between the well tool and the wellbore, and wherein the releasing step further comprises releasing the sealing engagement.

31. A method of releasing a well tool set in a wellbore, the method comprising the steps of:

providing the well tool being releasable by severing an internal mandrel of the well tool;

setting the well tool in the wellbore; and releasing the well tool by displacing a retaining device positioned at least partially in a flow passage extending through the well tool, the retaining device displacing step being performed in response to the piston displacing step.

32. A method of releasing a well tool set in a wellbore, the method comprising the steps of:

providing the well tool being releasable by severing an internal mandrel of the well tool;

setting the well tool in the wellbore;

releasing the well tool by displacing a retaining device positioned at least partially in a flow passage extending through the well tool; and interconnecting a coupling device between the retaining device and the piston, thereby permitting displacement of the retaining device relative to the piston.

33. The method according to claim 32, wherein in the interconnecting step, the coupling device permits displacement of the retaining device in response to displacement of the piston.

* * * * *